US012704121B2

(12) United States Patent
Hollnagel et al.

(10) Patent No.: US 12,704,121 B2
(45) Date of Patent: Aug. 11, 2026

(54) LOADING A FLUIDIC ELEMENT

(71) Applicant: DIONEX SOFTRON GMBH, Gemering (DE)

(72) Inventors: Christoph Hollnagel, Gauting (DE); Hermann Hochgräber, Offenberg (DE); Martin Rendl, Munich (DE); Anne Morgenstern, Gilching (DE)

(73) Assignee: Dionex Softron GmbH, Germering (DE)

( * ) Notice: Subject to any disclaimer, the term of this patent is extended or adjusted under 35 U.S.C. 154(b) by 813 days.

(21) Appl. No.: 17/937,562

(22) Filed: Oct. 3, 2022

(65) Prior Publication Data

US 2023/0160381 A1 May 25, 2023

(30) Foreign Application Priority Data

Sep. 3, 2021 (DE) ..... 102021122886.7

(51) Int. Cl.
*F04B 49/02* (2006.01)
*F04B 13/00* (2006.01)
*F04B 49/03* (2006.01)

(52) U.S. Cl.
CPC ..... *F04B 49/022* (2013.01); *F04B 13/00* (2013.01); *F04B 49/03* (2013.01); *F04B 2201/0601* (2013.01); *F04B 2205/04* (2013.01)

(58) Field of Classification Search
CPC ..... F04B 13/00; F04B 2201/0601; F04B 2205/04; F04B 49/022; F04B 49/03; G01N 2030/201; G01N 2030/202; G01N 2030/207; G01N 30/20; G01N 30/86
See application file for complete search history.

(56) References Cited

U.S. PATENT DOCUMENTS

| | | | | |
|---|---|---|---|---|
| 2010/0043539 | A1 | 2/2010 | Fadgen et al. | |
| 2018/0128789 | A1 * | 5/2018 | Hollnagel | G01N 30/20 |
| 2021/0123891 | A1 * | 4/2021 | Ciavarini | G01N 30/32 |

FOREIGN PATENT DOCUMENTS

| | | | | |
|---|---|---|---|---|
| DE | 102008006266 | A1 | 8/2009 | |
| DE | 102016121515 | A1 | 5/2018 | |
| EP | 1918705 | A1 * | 5/2008 | G01N 30/20 |

* cited by examiner

*Primary Examiner* — Jennifer Wecker
*Assistant Examiner* — Jonathan Bortoli

(57) ABSTRACT

The present invention relates to a method of loading a fluid into a fluidic element, wherein the method is performed in a fluidic system comprising the fluidic element, wherein the method comprises determining a volume that has flown into the fluidic element since a start time $t_{start}$, and at a switching time $t_{switch}$, switching the fluidic system to an operating state to stop flow into the fluidic element. The present invention also relates to a fluidic system configured for performing the method, and to a corresponding computer program product.

15 Claims, 13 Drawing Sheets

LOADING A FLUIDIC ELEMENT

CROSS-REFERENCE TO RELATED APPLICATIONS

This application claims the priority benefit under 35 U.S.C. § 119 to German Patent Application No. 10 2019 124 622.9, filed on Sep. 12, 2019, which application is hereby incorporated herein by references in its entirety.

FIELD OF THE INVENTION

The present invention relates generally to the operation of a fluidic system, and more particularly to a fluidic system comprising a fluidic element, for example a trap column. More particularly, the present invention relates to a method for accurate and efficient interrupted loading of fluid into the fluidic element.

BACKGROUND OF THE INVENTION

Embodiments of the present invention are targeted at the field of chromatography, particularly high-performance liquid chromatography (HPLC). They aim to enhance the performance of chromatographic separation, in particular focusing on improving the reproducibility, accuracy and throughput of chromatographic separation processes. They may be of particular advantage for chromatographic separations where preconcentration using trap columns is employed.

A typical chromatographic separation process may comprise various steps. In one step it may comprise, for example, a sample being picked up from a sample reservoir. After the sample is picked up, a sample loop is used to store the sample. The sample may then either be introduced directly into the analytical flow path by switching valves, or, may first be pushed on to a so-called trap column for preconcentration (the trap column may then be said to be "loaded") with the aid of a pumping device. This trap column or sample loop may then be switched into the analytical flow path. An analytical pump may then push the sample through the trap column in the same flow direction as used for the loading of the trap column, a so-called forward flush, or in the opposite flow direction as used for the loading of the trap column, a so-called backward flush. These steps may be enabled in HPLC systems with the help of samplers, which may be responsible for sample management and accurate sample injection.

Preconcentration with trap columns may help to protect the sensitive and more sophisticated separation column. For example, compounds that may adversely interact with the packing material in a separation column may inadvertently make their way into an HPLC system and change its separation properties which may affect comparability of the results/chromatograms. Using a trapping column that may effectively filter out such compounds may increase the lifetime of the separation column.

Preconcentration may also help to enrich the compounds of interest through binding to a solid phase in the trap column. The compounds interact with the solid phase of the trap column and are temporarily and reversibly bound, while the non-bound matrix solution can be removed in a flow-through scheme. This results in an enrichment of the analyte of interest.

Additionally, other matrix components of the sample that may not have bonded to the solid phase are simultaneously removed during the trap loading process. This may further allow removal of compounds that might interfere with the downstream analysis. Moreover, particulate matter or contaminants may be removed when the "forward flush" configuration is used.

Trap columns for preconcentration may also have a significantly lower fluidic backpressure compared to the analogous analytical columns. Thus, preconcentrating may occur at higher flow rates.

Owing to the lower backpressure (corresponding to a lower hydraulic resistance of the trap column), it may also help to use a separate loading pump to load the trap column in addition to the analytical pump that may be used to drive the analytical flow into the separation column, that may, for example, pump at higher pressures. Typically, this loading pump may be capable of generating a continuous flow. A pump that generates continuous flow may be more sophisticated and elaborate, but it simplifies accurate reproducibility of the flow. In this case, the flow may often not be terminated at all and injection may be triggered while the loading pump is still pumping. Pumping a constant flow, that may be guided to waste during the injection step, may be more precise and reproducible. Inaccuracies of the pump flow control during stopping and restarting the loading flow may thus be avoided. An inaccuracy may arise here only when the loading flow is ramped up, e.g., when operation of the system starts. This inaccuracy may usually be neglected.

Likewise, there may be pumps that have only a limited loading volume. In this case, the loading process may have to be interrupted before it is completed (for e.g., to refill the pump), the pressure may be brought close to zero (resulting in zero flow) and/or a valve may be switched (for example, to a waste reservoir) to stop flow into a trap column downstream of the loading pump (e.g., during the refill) after a defined time. When using a pump that cannot generate a continuous flow, flow inaccuracy problems may occur during loading when the flow ends because a refill of the pump is necessary or at the end of the loading process. It is an aspect of the present invention to allow for improved loading flow accuracy during interrupted loading, as well as more accurate positioning of the sample in a sample loop. This may be achieved by a monitored, feedback-controlled loading process.

It may also be advantageous for chromatographic separation processes to be reproducible as identification and quantification is achieved by comparing the sample containing the analyte of interest against a reference of known composition and concentration. In embodiments of the process where trap columns may be used for preconcentration, it may thence be advantageous for the process of preconcentration of the analyte to be reproducible as well. Incorrect or imprecise preconcentration, for e.g., due to inaccuracy in the volume of analyte loaded, may cause significant adverse effects on the performance of the chromatographic process.

For instance, if during the preconcentration step the actually loaded volume onto a trap column is lower than intended, the corresponding chromatogram in the downstream detection process will accordingly show peaks of incorrectly low peak height and area. Hence, the compound of interest may falsely be quantified to a lower than actual concentration. In contrast, in the case where the loading volume is higher than intended, early eluting compounds may be eluted inadvertently. As a result, these compounds would either be missing entirely or be represented by peaks of incorrectly low peak area and height. Hence, identification and quantification of these compounds would be incorrect. A monitored, feedback-controlled loading process that can deliver accurate loading volumes may also be particularly useful in such scenarios.

EP 1918705 A1 discloses a device and a method of loading a sample into a trapping device. While this technology disclosed in EP 1918705 A1 may be satisfactory in some regards, it has certain drawbacks and limitations, in particular with regard to precision and efficiency of the loading process.

In light of the above, it is an object of the present invention to provide a technology allowing a monitored, volume- and/or pressure-feedback controlled loading process. In particular, the technology should be relatively simple, accurate, time efficient, and provide diagnostic tools to monitor the loading process.

These objects are achieved by the present invention.

In a first aspect, the present invention relates to a method of loading a fluid into a fluidic element, wherein the method is performed in a fluidic system comprising the fluidic element, wherein the method comprises determining a volume that has flown into the fluidic element since a start time $t_{start}$, and at a switching time $t_{switch}$, switching the fluidic system to an operating state to stop flow into the fluidic element. The order of steps may not necessarily be as mentioned. For example, the flow into the fluidic element may be stopped after a defined volume of fluid has flowed into the fluidic element. Alternatively, the flow into the fluidic element may be stopped and then the volume of fluid that has flowed in may be determined. Furthermore, it should also be understood that the flow into the fluidic element does not have to stop immediately at the switching time $t_{switch}$. Instead, the skilled person will understand that the switching at switching time $t_{switch}$ causes the flow into the fluidic element to stop either immediately (e.g., when a portion upstream of the fluidic element is vented) or at a time after the switching time $t_{switch}$ (e.g., when operation of a pump is stopped such that a pressure upstream of the fluidic element dissipates more slowly).

The method may comprise measuring a flow rate and determining the volume that has flown into the fluidic element since a start time $t_{start}$ may be based on the measured flow rate. This may be achieved by simply integrating the flow rate over time. As such, using the flow rate to determine the flow volume may represent a relatively simple method for the same. However, measurements of flow rates may typically be done with relatively sophisticated sensors which may render the overall process more complex.

The fluidic system may comprise a loading pump, and the method may comprise operating the loading pump in a loading state from the start time $t_{start}$ to the switching time $t_{switch}$, wherein a pressure between the loading pump and the fluidic element exceeds ambient pressure and wherein the loading pump causes fluid flow into the fluidic element in the loading state. The loading state may be characterized by an operating pressure of the loading pump. For example, the operating pressure may be set to 1000 bar at the time $t_{start}$ and may then be switched to a lower pressure, say, 200 bar at the time $t_{switch}$. Then at $t_{start}$, the pressure between the loading pump and the fluidic element may start rising from the ambient pressure to 1000 bar, provided the loading volume of the pump is not exhausted before. This pressure difference between the loading pump and the fluidic element then drives fluid flow into the fluidic element.

Switching the fluidic system to an operating state to stop flow into the fluidic element may comprise switching the loading pump to a stop state, wherein the pressure between the loading pump and the fluidic element equals ambient pressure in the stop state. This may be achieved by lowering the operating pressure to the ambient pressure at the time $t_{switch}$ as described above, for example.

The loading pump may assume a start configuration at the start time $t_{start}$ and a stop configuration at a stop time $t_{stop}$, wherein $t_{stop}$ is later than $t_{start}$, and wherein in the step of determining the volume that has flown into the fluidic element since start time $t_{start}$, the volume is determined based on the start configuration and the stop configuration. The start and stop configurations may comprise the operating pressures of the loading pump, for example. In this case, the total volume of fluid that has flown into the fluidic element may be determined by relating the operating pressure to a flow rate of fluid and thus the flow volume. Or, the loading pump may comprise a piston and a housing and the start and stop configurations may comprise locations of the piston within the housing. These may then be converted into a flow volume by determining the volume displaced by the piston, for example.

The method as described above may further comprise sensing a pressure in the loading pump or fluidly connected thereto, and wherein determining the volume that has flown into the fluidic element since the start time $t_{start}$ is based on the sensed pressure.

The fluidic system may comprise a pressure sensor, and the method may further comprise using the pressure sensor to sense the pressure.

The fluidic system may comprise a flow rate sensor configured to measure a flow rate, and the method may further comprise using the measured flow rate to sense the pressure. As described above, flow rate sensors may be more sophisticated than pressure sensors making the process of determining flow volumes using flow rate sensors more complex. In addition, a pressure-controlled process that allows a defined volume of fluid to be pushed through a fluidic element may allow the fluidic system to be operated at improved efficiency since the fluidic system may be operated at a maximum loading pressure allowed by the fluidic system.

The flow rate sensor may be configured to measure the flow rate through a capillary tube. By measuring the flow rate through a capillary tube, the pressure difference across the tube may thus also be determined, since the two may be related. Thus, this may serve also as a pressure sensor. However, it may be difficult to ensure that conditions of laminar flow or incompressibility, that may be a condition for applicability of the relation, are maintained and the pressure measurement may be unreliable.

The flow rate sensor may comprise a heat source and at least two temperature sensors, and measuring the flow rate may comprise measuring the rate at which a heat pulse travels through the flow rate sensor.

The method may further comprise determining the switch time $t_{switch}$.

Determining the switch time $t_{switch}$ may be based on the determined volume that has flown into the fluidic element since the start time $t_{start}$. Based on a total volume of fluid that is intended be pushed through the fluidic element, a volume of fluid that may be pushed before the time $t_{switch}$ may be determined. Thus, once this defined volume of fluid has been pushed through, the operating state may be switched.

A maximum pressure between the loading pump and the fluidic element in the loading state may exceed the ambient pressure by a maximum differential pressure, wherein after a time period of at least 0.2 s to 15 s, preferably 0.5 s to 10 s, further preferably 1 s to 5 s after the switching time $t_{switch}$, the pressure between the loading pump and the fluidic element minus the ambient pressure may be less than 10% of the maximum differential pressure. This may provide an example of how fast the high loading pressure can be dissipated with the present invention. For example, if the pressure in the loading state is 1000 bar in excess of the ambient pressure, then in a time less than 5 sec after the operating state is switched to stop flow into the fluidic element the pressure between the loading pump and the fluidic element may be less than 100 bar in excess of the ambient pressure.

Determining the switch time $t_{switch}$ may also be based on a compression of the fluid at the pressure. This may be relevant as the compressed volume of fluid flows into the fluidic element after the time $t_{switch}$ even though the operating state has been switched to stop flow into the fluidic element. For example, if $t_{switch}$ is 1 sec assuming that a compression of the fluid is zero, then for a compressible fluid $t_{switch}$ would be lesser than 1 sec. The exact difference would depend on the compressibility of the fluid, with $t_{switch}$ being lesser for a more compressible fluid.

Determining the switch time $t_{switch}$ may also be based on an expected fluid flow ($V_{red}$) into the fluidic element after the switch time $t_{switch}$. As described above, some amount of fluid may flow into the fluidic element even after the time $t_{switch}$. For example, if a total volume 1 mL of fluid is to be pushed through the fluidic element, and the expected fluid flow $V_{red}$=0.1 mL, then $t_{switch}$ would be the time when 0.9 mL of fluid has already been pushed through the fluidic element. This may be a consequence of the compressibility of the fluid, as well as changes in the dimensions of the fluidic path under pressure.

A predefined volume of fluid may be loaded into the fluidic element.

The method as described above may comprise fluidly disconnecting the loading pump from the fluidic element at the time $t_{switch}$. This may represent one possibility of switching the operating state at $t_{switch}$.

The method may further comprise venting the fluidic element to ambient pressure at the time $t_{switch}$.

The method may further comprise switching the loading pump to ambient pressure at the time $t_{switch}$. This may represent another possibility of switching the operating state at $t_{switch}$.

Switching the loading pump to ambient pressure may comprise venting the loading pump.

Switching the loading pump to ambient pressure may comprise switching an operating pressure of the loading pump.

The loading pump may be a continuous pump configured to cause fluid to flow into the fluidic element continuously in the loading state and the method may further comprise supplying fluid to the continuous pump such that continuous flow of fluid into the fluidic element is maintained. These pumps may allow maintaining a stable flow rate, thus allowing an easy measurement of the volume of fluid already delivered into the fluidic element. However, they may be more sophisticated and complex.

Alternatively, the loading pump may be a non-continuous pump. Non-continuous pumps may be simpler and easier to operate than continuous pumps. However, owing to the intermittent disruption of flow and a possible compression of the fluid and/or change in the volume of the fluidic path, measuring the volume of fluid delivered to the fluidic element may be more involved.

The volume of the non-continuous pump may be less than the predefined volume, and the volume delivered through the fluidic element in each of the intermittent flows may be less than the predefined volume. Thus, the non-continuous pump may be refilled and the fluid may be pushed through the fluidic element multiple times. As described above, this may make determining the volume of fluid delivered into the fluidic element up to any given time more involved than with a continuous pump.

Alternatively, the volume of the non-continuous pump may be at least equal to the predefined volume, but less than the sum of a compression volume of the fluid and the predefined volume of fluid. In this case, the compressed volume of fluid may also flow into the fluidic element and an accurate estimation of the compressed volume may be advantageous to deliver the predefined volume of fluid to the fluidic element.

The method may further comprise supplying fluid to refill the non-continuous pump.

The loading pump may be a metering device. The metering device may comprise a housing and a piston.

The pressure in the loading state described above may exceed the ambient pressure by a maximum differential pressure, wherein the maximum differential pressure preferably is more than 500 bar, further preferably is more than 1000 bar, such as more than 1500 bar.

The method as described above may comprise sensing the pressure once at the time $t_{start}$ and once again at the time $t_{stop}$, wherein the method may further comprise determining the volume that has flown into the fluidic element since a time $t_{start}$ based on the start and stop configurations of the loading pump when the two measurements of pressure differ by less than 50% of the maximum differential pressure, preferably by less than 10% of the maximum differential pressure, further preferably by less than 1% of the maximum differential pressure, such as by less than 0.1% of the maximum differential pressure. For example, a pressure at $t_{start}$ may be significantly identical to the ambient pressure and the loading process may be started by increasing the pressure. Once a defined volume of fluid has been loaded into the fluidic element, the pressure in the loading pump may be allowed to come to a pressure close to the ambient pressure again, that may be forced by the controlled reverse traversal of the pump or metering device piston, for example. The displacement of the piston after the reverse traversal may then indicate the volume of fluid loaded into the fluidic element.

For example, the pressure at the time $t_{start}$ and at the stop time $t_{stop}$ may differ by less than 50 bar, preferably by less than 10 bar, such as within by less than 2 bar.

The fluidic element may be a trap column. As described above, a trap column may be advantageous in preconcentration of the sample, and it may be advantageous for a robust chromatographic separation process to use embodiments of the present technology for loading a defined volume of fluid into the trap column.

The fluidic element may be a sample loop. A sample loop may already have a defined volume but embodiments of the present technology may help deliver an accurate volume of fluid into the sample loop, e.g., in a pushed loop injection mode. In particular when using a sample loop as the fluidic element, it may be advantageous to deliver a precise volume through the sample loop, to position the complete sample plug from the needle into the sample loop prior the injection. Only the liquid portions that reside in the sample loop prior injection will typically be injected onto the separation column for analysis. If the sample plug is pushed to far, the fronting sample volume gets lost to waste, and will not be injected onto the separation column. If it is pushed to short, then sample volume is not yet fully positioned in the sample loop and will also not be injected completely. This is why it is advantageous to precisely deliver a volume into the sample loop.

The metering device may comprise a first port and a second port, and the fluidic system may further comprise a sample storage section, a sample reservoir, a sample pick up means seat, a sample pick up means, an analytical pump, a separation column, a waste reservoir, at least one solvent reservoir, a first distributor valve comprising a plurality of ports and a plurality of connecting elements configured to changeably connect to the plurality of ports on the first distributor valve, wherein the plurality of ports on the first distributor valve comprises

- a first port directly fluidly connected to the seat,
- a second port and a third port that are both directly fluidly connected to the trap column,
- a fourth port directly fluidly connected to the separation column,
- a fifth port directly fluidly connected to the analytical pump, and
- a sixth port directly fluidly connected to a second distributor valve, the second distributor valve comprising a plurality of ports and a plurality of connecting elements configured to changeably connect to the plurality of ports on the second distributor valve, wherein the plurality of ports on the second distributor valve comprises,

- a seventh port directly fluidly connected to the first distributor valve,
- an eighth port directly fluidly connected to the waste,
- a ninth port directly fluidly connected to one of the at least one solvent reservoir, and
- a tenth port directly fluidly connected to the pressure sensor, wherein the pressure sensor may be fluidly connected to the first port of the metering device, and the sample storage section may be fluidly connected to the second port of the metering device.

The method may further comprise fluidly connecting the first port and the second port, the third port and the sixth port, the fourth port and the fifth port, the ninth port and the tenth port, the seventh port to a dead end, and the eighth port to a dead end, and the system thereby assuming a solvent intake configuration, and using the metering device to suck in solvent from one of the at least one solvent reservoir in the solvent intake configuration.

The method may further comprise fluidly disconnecting the ninth and tenth ports, moving the sample pick up means to the sample reservoir, and the system thereby assuming a sample intake configuration, and using the metering device to suck in the sample in the sample intake configuration.

The method may further comprise moving the sample pick up means back into the sample pick up means seat, fluidly connecting the seventh and eighth ports and using the metering device to load the trap column, wherein the trap column may be fluidly connected to the waste reservoir, and wherein the method may further comprise using the pressure sensor to determine the volume of fluid already pushed into the trap column.

The method may further comprise fluidly disconnecting the trap column from the waste reservoir and fluidly connecting it to a dead end, and using the metering device to further pressurize the trap column. This may be done if the loading process is followed by a separation process for which the trap column is advantageously pressurized to an analytical pressure.

The method may comprise fluidly disconnecting the first and second ports, and fluidly connecting the second and fourth ports, and the third and fifth ports, and the analytical pump may drive an analytical flow through the trap column into the separation column, in a direction opposite to the direction in which the trap column was loaded. This may correspond to the "backward flush" configuration described above, where fluid may be pushed out of the trap column in a direction opposite to the one in which it was loaded.

The method may comprise fluidly disconnecting the first and second ports, and fluidly connecting the second and fifth ports, and the third and fourth ports, and the analytical pump driving an analytical flow through the trap column into the separation column, in a direction which is identical to the direction in which the trap column was loaded. This may correspond to the "forward flush" configuration as described above.

The method may further comprise fluidly connecting the trap column to a dead end and the metering device depressurizing the trap column. This may be of advantage for a subsequent separation where the trap column may need to be washed and re-equilibrated.

The method may further comprise the metering device washing the trap column while the trap column is fluidly connected to the waste reservoir. Thus, the metering device may be used to not only load the trap column but also to (de)pressurize it and to wash it.

The method may further comprise the metering device washing the sample pick up means seat or the sample storage section.

The sample pick up means may be a needle.

The sample storage section may be a sample loop. The sample loop used as a sample storage section may also be referred to as sample storage loop.

At least one solvent reservoir may comprise 2 solvent reservoirs, and wherein the ninth port on the second distributor valve may be directly fluidly connected to one of the two solvent reservoirs and an eleventh port on the second distributor valve may be directly fluidly connected to the other solvent reservoir. For example, one of the solvents may comprise a solvent to be used for loading and/or separation, whereas the second solvent may be used for washing the fluidic channels.

The fluidic system may further comprise a control unit configured to regulate flow of fluid through the fluidic element based on the volume of fluid that has flown into the fluidic element since the time $t_{start}$. The control unit may be configured to be connected to different components of the fluidic system as described above enabling the method as described here to be carried out.

The method may further comprise the control unit regulating the flow of fluid by switching the loading pump. For example, it may switch the operating state of the loading pump by changing an operating pressure of the loading pump. It may cause the operating pressure to be a high value, such as 1000 bar, at the start of the loading process, and switch the operating pressure to a low value, such as 200 bar, at the time $t_{switch}$.

The control unit may stop flow of fluid into the fluidic element once the predefined volume of fluid has been loaded into the fluidic element. Thus, it may allow for, at least partial, automated control of the loading process by taking into account the compressibility of the fluid and the change in volume of the fluidic channels under pressure.

The control unit may keep the non-continuous pump in the loading state until the predefined volume of fluid has been loaded into the fluidic element. Once the predefined volume of fluid has been loaded into the fluidic element, the control unit may switch the loading pump to zero flow.

The fluidic system may switch a flow out of the fluidic element to zero, and the method may further comprise varying the pressure of the loading pump and measuring the volume of fluid compressed. These measurements may be used, for example, to establish a relationship between the pressure of the loading pump and the compression volume. This relation may then be used to determine the compression volume based on the pressure of the loading pump. The volume of fluid compressed may also be referred to as compression volume and denotes the amount of volume about which the fluid in the fluidic system is reduced, i.e., compressed.

The volume of fluid compressed may be measured using the start and stop configuration of the loading pump for different pressures of the loading pump. For example, in a start configuration, the pressure at the loading pump may be equal to the ambient pressure. Then, a pressure of the loading pump may be increased by moving, for example, a piston of the loading pump and blocking flow out of the fluidic element. In this configuration, the corresponding position of the piston measured. Thus, by using the difference in piston positions the volume of fluid compressed may be measured.

The fluidic system may further comprise a memory configured to at least store data relating the pressure and compression volume of at least one fluid. This data may then be subsequently used for determining the compression volume from the pressure of the loading pump without the need for measuring the compression volume again, so long as the fluid is not changed.

The data relating the pressure and compression volume may be experimental data. As described above, this may comprise measuring both the pressure and compression volume for a fluid.

The data relating the pressure and compression volume may be model data based on experimental data. For example, using a set of measurements, an interpolation may be made, or a parametric model be fitted, to derive a model relating the pressure and compression volume for a fluid. Models may be advantageous in efficiently determining the compression volume for a given pressure in subsequent separation processes.

The memory may be further configured to allow retrieval of data stored on it.

The method may further comprise, at the start time $t_{start}$, increasing the pressure in the loading pump to compress the fluid such that no fluid flows out of the fluidic element, measuring the compression volume, $V_{lag}$, and comparing it to an expected compression volume at the corresponding pressure. The increase in pressure may be below 10 bar, preferably below 5 bar, such as below 2 bar. This may be of advantage in testing the fluidic system for leaks and the fluid for air bubbles, etc. For example, if the compression volume is much larger than the expected compression volume, this may indicate presence of air bubbles in the fluid or leaks in the fluidic system.

The expected compression volume may be retrieved from the memory. It may be based on either experimental data or a model as described above.

The expected compression volume may be based on comparing a compressibility of the fluid to the compressibility of other fluids for which data is retrieved from the memory. For example, the memory may store data corresponding to a first fluid with a certain compressibility. Then, in order to determine the expected compression volume for a second fluid with, for example, a higher compressibility one may use the expected compression volume for the first fluid and, for example, scale it by a factor proportional to the ratio of the compressibility of the second fluid and the first fluid. More generally, a relationship may be obtained between the compressibility of a fluid and its expected compression volume based on the data stored in the memory and the relationship used later on for fluids for which there is no data stored in the memory.

The expected compression volume may be a volume calculated by considering one or more of compressibility of the fluid, a volume of the fluidic conduits, an elasticity of the fluidic conduits, and an elasticity of the piston seals of the loading pump. For example, it may be possible to compute the expected compression volume using physical models based on compressibility of the fluid, a volume of the fluidic conduits, an elasticity of the fluidic conduits, an elasticity of the piston seals of the loading pump, and other aspects relevant to the process.

The fluidic system may further comprise a valve downstream of the fluidic element configured to stop flow out of the fluidic element, and the method may further comprise pressurizing the fluidic element to a pressure higher than the ambient pressure after the predefined volume of fluid has been loaded into the fluidic element. As described above, this may be of advantage in pressurizing the fluid for a subsequent separation process, that may be carried out at a pressure higher than the ambient pressure.

The pressure to which the fluidic system may be pressurized at a time later than $t_{switch}$ is higher than the ambient pressure by more than 200 bar, preferably more than 500 bar, further preferably more than 1000 bar.

The method may not use a flow sensor to determine the volume that has flown into the fluidic element since a start time $t_{start}$. Flow sensors may be more sophisticated and complex to operate and so their use may be omitted by embodiments of the present technology.

In the step of sensing a pressure in the loading pump or fluidly connected thereto, the pressure may be indirectly sensed. That is, the pressure may not be sensed by means of a pressure sensor but by other means that may measure another physical property that may be then related to the pressure.

A power and/or current consumption of the loading pump may be used to indirectly sense the pressure. For example, a linear relationship may hold between the power of the loading pump and the pressure. Then, if the power consumed is doubled, the pressure of the loading pump would also be doubled. Alternatively, a quadratic relationship may hold between the current consumption and pressure of the loading pump. In this case, a doubling of the current consumption may indicate a quadrupling (factor 4 increase) of the pressure of the loading pump.

In a second aspect, the present invention relates to a computer program product comprising instructions, wherein the instructions are configured, when run on a control unit of a fluidic system, to cause the fluidic system to perform the method according to any of the preceding method embodiments. For example, the computer program product may comprise instructions causing the operating state of the loading pump to switch to zero flow once a defined volume of fluid is measured to have been loaded into the fluidic element.

In a third aspect, the present invention relates to a fluidic system, wherein the fluidic system comprises a fluidic element, wherein the fluidic system is configured to perform the method according to any of the preceding method embodiments.

The fluidic element may be a trap column.

The fluidic system may further comprise a loading pump upstream of the fluidic element, and the loading pump may be configured to operate in a loading state causing fluid to flow into the fluidic element at a pressure exceeding ambient pressure and in a time interval defined by the time $t_{start}$ and $t_{switch}$.

The fluidic system may further comprise at least one pressure sensor configured to measure the pressure in the loading pump or at a location fluidly connected thereto.

The fluidic system may comprise a flow rate sensor configured to measure a flow rate of fluid, wherein the fluidic system may be configured to sense a pressure in the loading pump or at a location fluidly connected thereto based on the measured flow rate.

The loading pump may be a continuous pump configured to cause fluid flow into the fluidic element continuously from the time start to $t_{start}$ to $t_{switch}$ at the pressure exceeding ambient pressure.

The fluidic system may be further configured to supply fluid to the continuous pump while it is operating in the loading state such that continuous operation is maintained.

The loading pump may be a non-continuous pump.

The loading pump may be a metering device. The metering device may comprise a housing and a piston.

The metering device may comprise a first port and a second port, and the fluidic system may further comprise a sample storage section, a sample reservoir, a sample pick up means seat, a sample pick up means, an analytical pump, a separation column, a waste reservoir, at least one solvent reservoir,

- a first distributor valve comprising a plurality of ports and a plurality of connecting elements configured to changeably connect to the plurality of ports on the first distributor valve, wherein the plurality of ports on the first distributor valve comprises
- a first port directly fluidly connected to the seat,
- a second port and a third port that are both directly fluidly connected to the trap column,
- a fourth port directly fluidly connected to the separation column,
- a fifth port directly fluidly connected to the analytical pump, and
- a sixth port directly fluidly connected to a second distributor valve, the second distributor valve comprising a plurality of ports and a plurality of connecting elements configured to changeably connect to the plurality of ports on the second distributor valve, wherein the plurality of ports on the second distributor valve comprises,

- a seventh port directly fluidly connected to the first distributor valve,
- an eighth port directly fluidly connected to the waste,
- a ninth port directly fluidly connected to one of the at least one solvent reservoir, and
- a tenth port directly fluidly connected to the pressure sensor, wherein the pressure sensor may be fluidly connected to the first port of the metering device, and the sample storage section may be fluidly connected to the second port of the metering device.

The sample pick up means may be a needle.

The sample storage section may be a sample loop. The sample loop used as a sample storage section may also be referred to as sample storage loop.

The at least one solvent reservoir may comprise 2 solvent reservoirs, and the ninth port of the second distributor valve may be directly fluidly connected to one of the two solvent reservoirs and an eleventh port of the second distributor valve may be directly fluidly connected to the other solvent reservoir.

The fluidic system may further comprise a control unit configured to regulate flow of fluid through the fluidic element based on the volume of fluid that has flown into the fluidic element since the time $t_{start}$.

The control unit may be configured to regulate the flow of fluid by switching the loading pump.

The fluidic system may further comprise a memory configured to at least store data.

The memory may be further configured to allow retrieval of data stored on it.

The fluidic system may further comprise a valve downstream of the fluidic element configured to stop flow out of the fluidic element.

In a fourth aspect, the present invention relates to a use of the fluidic system as described above in liquid chromatography, preferably in high performance liquid chromatography. As described above, embodiments of the present technology may be of particular relevance to liquid chromatography allowing, among other things, use of non-continuous loading pumps that are simpler and easier to operate, with robust and repeatable results.

Embodiments of the present invention are particularly suitable for intermittent loading and allow to overcome inaccuracies caused by a limited loading volume during refills. Embodiments therefore overcome special inaccuracy problems of intermittent loading, which are present in prior art solutions.

The present invention is also defined by the following numbered aspects.

Below, method embodiments will be discussed. These embodiments are abbreviated by the letter M followed by a number. Whenever reference is herein made to method embodiments, these embodiments are meant.

M1. A method of loading a fluid into a fluidic element, wherein the method is performed in a fluidic system comprising the fluidic element, wherein the method comprises

- determining a volume that has flown into the fluidic element since a start time $t_{start}$, and
- at a switching time $t_{switch}$, switching the fluidic system to an operating state to stop flow into the fluidic element.

M2. The method according to the preceding embodiment, wherein the method comprises measuring a flow rate and wherein determining the volume that has flown into the fluidic element since a start time $t_{start}$ is based on the measured flow rate.

M3. The method according to any of the preceding embodiments, wherein the fluidic system comprises a loading pump, and wherein the method comprises

- operating the loading pump in a loading state from the start time $t_{start}$ to the switching time $t_{switch}$, wherein a pressure between the loading pump and the fluidic element exceeds ambient pressure and wherein the loading pump causes fluid flow into the fluidic element in the loading state.

M4. The method according to the preceding embodiment, wherein switching the fluidic system to an operating state to stop flow into the fluidic element comprises switching the loading pump to a stop state, wherein the pressure between the loading pump and the fluidic element equals ambient pressure in the stop state.

M5. The method according to the preceding embodiment, wherein the loading pump assumes a start configuration at the start time $t_{start}$ and a stop configuration at a stop time $t_{stop}$, wherein $t_{stop}$ is later than $t_{start}$, and wherein in the step of determining the volume that has flown into the fluidic element since start time $t_{start}$, the volume is determined based on the start configuration and the stop configuration.

M6. The method according to any of the preceding embodiments with the features of embodiment M3, wherein the method comprises sensing a pressure in the loading pump or fluidly connected thereto, and wherein determining the volume that has flown into the fluidic element since the start time $t_{start}$ is based on the sensed pressure.

M7. The method according to the preceding embodiment, wherein the fluidic system comprises a pressure sensor, and wherein the method further comprises using the pressure sensor to sense the pressure.

M8. The method according to the penultimate embodiment, wherein the fluidic system comprises a flow rate sensor configured to measure a flow rate, and wherein the method further comprises using the measured flow rate to sense the pressure.

M9. The method according to the preceding embodiment, wherein the flow rate sensor is configured to measure the flow rate through a capillary tube.

M10. The method according to any of the 2 preceding embodiments, wherein the flow rate sensor comprises a heat source and at least two temperature sensors, and wherein measuring the flow rate comprises measuring the rate at which a heat pulse travels through the flow rate sensor.

M11. The method according to any of the preceding embodiments, wherein the method further comprises determining the switch time $t_{switch}$.

M12. The method according to the preceding embodiment, wherein determining the switch time $t_{switch}$ is based on the determined volume that has flown into the fluidic element since the start time $t_{start}$.

M13. The method according to any of the preceding embodiments with the features of embodiment M3, wherein a maximum pressure between the loading pump and the fluidic element in the loading state exceeds the ambient pressure by a maximum differential pressure, wherein after a time period of 0.2 s to 15 s, preferably 0.5 s to 10 s, further preferably 1 s to 5 s after the switching time $t_{switch}$, the pressure between the loading pump and the fluidic element minus the ambient pressure is less than 10% of the maximum differential pressure.

M14. The method according to any of the preceding embodiments with the features of embodiments M6 and M12, wherein determining the switch time $t_{switch}$ is also based on a compression of the fluid at the pressure.

M15. The method according to any of the preceding embodiments with the features of embodiment M11, wherein determining the switch time $t_{switch}$ is also based on an expected fluid flow ($V_{red}$) into the fluidic element after the switch time $t_{switch}$.

M16. The method according to any of the preceding embodiments, wherein a predefined volume of fluid is loaded into the fluidic element.

M17. The method according to any of the preceding embodiments without the features of embodiment M4 and with the features of embodiment M3, wherein the method comprises fluidly disconnecting the loading pump from the fluidic element at the time $t_{switch}$.

M18. The method according to the preceding embodiment, wherein the method further comprises venting the fluidic element to ambient pressure at the time $t_{switch}$.

M19. The method according to any of the 2 preceding embodiments, wherein the method further comprises switching the loading pump to ambient pressure at the time $t_{switch}$.

M20. The method according to the preceding embodiment, wherein switching the loading pump to ambient pressure comprises venting the loading pump.

M21. The method according to the penultimate embodiment, wherein switching the loading pump to ambient pressure comprises switching an operating pressure of the loading pump.

M22. The method according to any of the preceding embodiments and with the features of embodiment M3, wherein the loading pump is a continuous pump configured to cause fluid to flow into the fluidic element continuously in the loading state.

M23. The method according to the preceding embodiment, wherein the method further comprises supplying fluid to the continuous pump such that continuous flow of fluid into the fluidic element is maintained.

M24. The method according to any of the preceding embodiments and with the features of embodiment M3 but without the features of any of the 2 preceding embodiments, wherein the loading pump is a non-continuous pump.

M25. The method according to the preceding embodiment and with the features of embodiment M16, wherein the volume of the non-continuous pump is less than the predefined volume, and wherein the volume delivered through the fluidic element in each of the intermittent flows is less than the predefined volume.

M26. The method according to the penultimate embodiment and with the features of embodiment M16 but without the features of the preceding embodiment, wherein the volume of the non-continuous pump is at least equal to the predefined volume, but less than the sum of a compression volume of the fluid and the predefined volume of fluid.

M27. The method according to any of the 3 preceding embodiments, wherein the method further comprises supplying fluid to refill the non-continuous pump.

M28. The method according to any of the preceding embodiments and with the features of embodiment M3, wherein the loading pump is a metering device.

M29. The method according to any of the preceding embodiments and with the features of embodiment M3, wherein the pressure in the loading state exceeds the ambient pressure by a maximum differential pressure, wherein the maximum differential pressure preferably is more than 500 bar, further preferably more than 1000 bar, such as more than 1500 bar.

M30. The method according to the preceding embodiment and with the features of embodiments M5 and M6, wherein the method comprises sensing the pressure once at the time $t_{start}$ and once again at the time $t_{stop}$, wherein the method further comprises determining the volume that has flown into the fluidic element since a time $t_{start}$ based on the start and stop configurations of the loading pump when the two measurements of pressure differ by less than 50% of the maximum differential pressure, preferably by less than 10% of the maximum differential pressure, further preferably by less than 1% of the maximum differential pressure, such as by less than 0.1% of the maximum differential pressure.

M31. The method according to any of the preceding embodiments, wherein the fluidic element is a trap column.

M32. The method according to any of the preceding embodiments and with the features of embodiment M28, wherein the metering device comprises a housing and a piston.

M33. The method according to any of the preceding embodiments, wherein the fluidic element is a sample loop.

M34. The method according to any of the preceding embodiments and with the features of embodiments M7, M28, and M31, wherein the metering device comprises a first port and a second port, and wherein the fluidic system further comprises a sample storage section, a sample reservoir, a sample pick up means seat, a sample pick up means, an analytical pump, a separation column, a waste reservoir, at least one solvent reservoir, a first distributor valve comprising a plurality of ports and a plurality of connecting elements configured to changeably connect to the plurality of ports on the first distributor valve, wherein the plurality of ports on the first distributor valve comprises a first port directly fluidly connected to the seat, a second port and a third port that are both directly fluidly connected to the trap column, a fourth port directly fluidly connected to the separation column, a fifth port directly fluidly connected to the analytical pump, and a sixth port directly fluidly connected to a second distributor valve, the second distributor valve comprising a plurality of ports and a plurality of connecting elements configured to changeably connect to the plurality of ports on the second distributor valve, wherein the plurality of ports on the second distributor valve comprises, a seventh port directly fluidly connected to the first distributor valve, an eighth port directly fluidly connected to the waste, a ninth port directly fluidly connected to one of the at least one solvent reservoir, and a tenth port directly fluidly connected to the pressure sensor, wherein the pressure sensor is fluidly connected to the first port of the metering device, and the sample storage section is fluidly connected to the second port of the metering device.

M35. The method according to the preceding embodiment, wherein the method further comprises fluidly connecting the first port and the second port, the third port and the sixth port, the fourth port and the fifth port, the ninth port and the tenth port, the seventh port to a dead end, and the eighth port to a dead end, and the system thereby assuming a solvent intake configuration, and wherein the method further comprises using the metering device to suck in solvent from one of the at least one solvent reservoir in the solvent intake configuration.

M36. The method according to the preceding embodiment, wherein the method further comprises fluidly disconnecting the ninth and tenth ports, moving the sample pick up means to the sample reservoir, and the system thereby assuming a sample intake configuration, and using the metering device to suck in the sample in the sample intake configuration.

M37. The method according to any of the preceding embodiments and with the features of any of the 2 preceding embodiments, wherein the method further comprises moving the sample pick up means back into the sample pick up means seat, fluidly connecting the seventh and eighth ports and using the metering device to load the trap column, wherein the trap column is fluidly connected to the waste reservoir, and wherein the method further comprises using the pressure sensor to determine the volume of fluid already pushed into the trap column.

M38. The method according to the preceding embodiment, wherein the method further comprises fluidly disconnecting the trap column from the waste reservoir and fluidly connecting it to a dead end, and using the metering device to further pressurize the trap column.

M39. The method according to the preceding embodiment, wherein the method comprises fluidly disconnecting the first and second ports, and fluidly connecting the second and fourth ports, and the third and fifth ports, and the analytical pump driving an analytical flow through the trap column into the separation column, in a direction opposite to the direction in which the trap column was loaded.

M40. The method according to the penultimate embodiment, wherein the method comprises fluidly disconnecting the first and second ports, and fluidly connecting the second and fifth ports, and the third and fourth ports, and the analytical pump driving an analytical flow through the trap column into the separation column, in a direction which is identical to the direction in which the trap column was loaded.

M41. The method according to any of the 2 preceding embodiments, wherein the method further comprises fluidly connecting the trap column to a dead end and the metering device de-pressurizing the trap column.

M42. The method according to the preceding embodiment, wherein the method further comprises the metering device washing the trap column while the trap column is fluidly connected to the waste reservoir.

M43. The method according to any of the preceding embodiments with the features of embodiment M34, wherein the method further comprises the metering device washing the sample pick up means seat or the sample storage section.

M44. The method according to any of the preceding embodiments and with the features of embodiment M34, wherein the sample pick up means is a needle.

M45. The method according to the any of the preceding embodiments and with the features of embodiment M34, wherein the sample storage section is a sample loop.

M46. The method according to any of the preceding embodiments and with the features of embodiment M34, wherein the at least one solvent reservoir is 2 solvent reservoirs, and wherein the ninth port on the second distributor valve is directly fluidly connected to one of the two solvent reservoirs and an eleventh port on the second distributor valve is directly fluidly connected to the other solvent reservoir.

M47. The method according to any of the preceding embodiments, wherein the fluidic system further comprises a control unit configured to regulate flow of fluid through the fluidic element based on the volume of fluid that has flown into the fluidic element since the time $t_{start}$.

M48. The method according to the preceding embodiment and with the features of embodiment M3, wherein the method further comprises the control unit regulating the flow of fluid by switching the loading pump.

M49. The method according to any of the two preceding embodiments and with the features of embodiment M16, wherein the control unit stops flow of fluid into the fluidic element once the predefined volume of fluid has been loaded into the fluidic element.

M50. The method according to the preceding embodiment and with the features of embodiments M24 and M48, wherein the control unit keeps the non-continuous pump in the loading state until the predefined volume of fluid has been loaded into the fluidic element.

M51. The method according to any of the preceding embodiments and with the features of embodiments M3, wherein the fluidic system switches a flow out of the fluidic element to zero, and wherein the method further comprises varying the pressure of the loading pump and measuring the volume of fluid compressed.

M52. The method according to the preceding embodiment and with the features of embodiment M5, wherein the volume of fluid compressed is measured using the start and stop configuration of the loading pump for different pressures of the loading pump.

M53. The method according to any of the preceding embodiments and with the features of embodiment M51, wherein the fluidic system further comprises a memory configured to at least store data relating the pressure and compression volume of at least one fluid.

M54. The method according to the preceding embodiment, wherein the data relating the pressure and compression volume is experimental data.

M55. The method according to the penultimate embodiment, wherein the data relating the pressure and compression volume is model data based on experimental data.

M56. The method according to any of the preceding embodiments and with the features of embodiment M53, wherein the memory is further configured to allow retrieval of data stored on it.

M57. The method according to the preceding embodiment, wherein the method further comprises, at the start time $t_{start}$, increasing the pressure in the loading pump to compress the fluid such that no fluid flows out of the fluidic element, wherein the method further comprises measuring the compression volume, $V_{lag}$, and comparing it to an expected compression volume at the corresponding pressure.

M58. The method according to the preceding embodiment and with the features of embodiment M53, wherein the expected compression volume is retrieved from the memory.

M59. The method according to any of the 2 preceding embodiments, wherein the expected compression volume is based on comparing a compressibility of the fluid to the compressibility of other fluids for which data is retrieved from the memory.

M60. The method according to any of the preceding embodiments and with the features of embodiment M57, wherein the expected compression volume is a volume calculated by considering one or more of compressibility of the fluid, a volume of the fluidic conduits, an elasticity of the fluidic conduits, and an elasticity of the piston seals of the loading pump.

M61. The method according to any of the preceding embodiments and with the features of embodiment M57, wherein the increase in pressure is below 10 bar, preferably below 5 bar, such as below 2 bar.

M62. The method according to any of the preceding embodiments and with the features of embodiment M16, wherein the fluidic system further comprises a valve downstream of the fluidic element configured to stop flow out of the fluidic element, and wherein the method further comprises, pressurizing the fluidic element to a pressure higher than the ambient pressure after the predefined volume of fluid has been loaded into the fluidic element.

M63. The method according to the preceding embodiment, wherein the pressure to which the fluidic system is pressurized at a time later than $t_{switch}$ is higher than the ambient pressure by more than 200 bar, preferably more than 500 bar, further preferably more than 1000 bar.

M64. The method according to any of the preceding embodiments without the features of embodiment M8, wherein the method does not use a flow sensor to determine the volume that has flown into the fluidic element since a start time $t_{start}$.

M65. The method according to any of the preceding embodiments with the features of embodiment M6, wherein in the step of sensing a pressure in the loading pump or fluidly connected thereto, the pressure is indirectly sensed.

M66. The method according to the preceding embodiment, wherein power and/or current consumption of the loading pump is used to indirectly sense the pressure.

P1. A computer program product comprising instructions, wherein the instructions are configured, when run on a control unit of a fluidic system, to cause the fluidic system to perform the method according to any of the preceding method embodiments.

Below, system embodiments will be discussed. These embodiments are abbreviated by the letter S followed by a number. Whenever reference is herein made to system embodiments, these embodiments are meant.

S1. A fluidic system, wherein the fluidic system comprises a fluidic element, wherein the fluidic system is configured to perform the method according to any of the preceding method embodiments.

S2. The fluidic system according to the preceding embodiment, wherein the fluidic element is a trap column.

S3. The fluidic system according to any of the preceding system embodiments, wherein the fluidic system further comprises a loading pump upstream of the fluidic element, and wherein the loading pump is configured to operate in a loading state causing fluid to flow into the fluidic element at a pressure exceeding ambient pressure and in a time interval defined by the time $t_{start}$ and $t_{switch}$.

S4. The fluidic system according to the any of the preceding system embodiments and with the features of embodiment S3, wherein the fluidic system further comprises at least one pressure sensor configured to measure the pressure in the loading pump or at a location fluidly connected thereto.

S5. The fluidic system according to any of the preceding system embodiments and with the features of embodiment S3, wherein the fluidic system comprises a flow rate sensor configured to measure a flow rate of fluid, and wherein the fluidic system is configured to sense a pressure in the loading pump or at a location fluidly connected thereto based on the measured flow rate.

S6. The fluidic system according to any of the preceding system embodiments and with the features of embodiment S3, wherein the loading pump is a continuous pump configured to cause fluid flow into the fluidic element continuously from the time $t_{start}$ to $t_{switch}$ at the pressure exceeding ambient pressure.

S7. The fluidic system according to the preceding embodiment, wherein the fluidic system is further configured to supply fluid to the continuous pump while it is operating in the loading state such that continuous operation is maintained.

S8. The fluidic system according to any of the preceding system embodiments and with the features of embodiment S3 but without the features of any of the 2 preceding embodiments, wherein the loading pump is a non-continuous pump.

S9. The fluidic system according to any of the preceding system embodiments and with the features of embodiment S3, wherein the loading pump is a metering device.

S10. The fluidic system according to any of the preceding system embodiments and with the features of embodiments S3, S4, and S9, wherein the metering device comprises a first port and a second port, and wherein the fluidic system further comprises a sample storage section, a sample reservoir, a sample pick up means seat, a sample pick up means, an analytical pump, a separation column, a waste reservoir, at least one solvent reservoir, a first distributor valve comprising a plurality of ports and a plurality of connecting elements configured to changeably connect to the plurality of ports on the first distributor valve, wherein the plurality of ports on the first distributor valve comprises a first port directly fluidly connected to the seat, a second port and a third port that are both directly fluidly connected to the trap column, a fourth port directly fluidly connected to the separation column, a fifth port directly fluidly connected to the analytical pump, and a sixth port directly fluidly connected to a second distributor valve, the second distributor valve comprising a plurality of ports and a plurality of connecting elements configured to changeably connect to the plurality of ports on the second distributor valve, wherein the plurality of ports on the second distributor valve comprises, a seventh port directly fluidly connected to the first distributor valve, an eighth port directly fluidly connected to the waste, a ninth port directly fluidly connected to one of the at least one solvent reservoir, and a tenth port directly fluidly connected to the pressure sensor, wherein the pressure sensor is fluidly connected to the first port of the metering device, and the sample storage section is fluidly connected to the second port of the metering device.

S11. The fluidic system according to any of the preceding system embodiments and with the features of embodiment S10, wherein the sample pick up means is a needle.

S12. The fluidic system according to any of the preceding system embodiments and with the features of embodiment S10, wherein the sample storage section is a sample loop.

S13. The fluidic system according to any of the preceding system embodiments and with the features of embodiment S10, wherein the at least one solvent reservoir is 2 solvent reservoirs, and wherein the ninth port of the second distributor valve is directly fluidly connected to one of the two solvent reservoirs and an eleventh port of the second distributor valve is directly fluidly connected to the other solvent reservoir.

S14. The fluidic system according to any of the preceding embodiments and with the features of embodiment S9, wherein the metering device comprises a housing and a piston.

S15. The fluidic system according to any of the preceding system embodiments, wherein the fluidic system further comprises a control unit configured to regulate flow of fluid through the fluidic element based on the volume of fluid that has flown into the fluidic element since the time $t_{start}$.

S16. The fluidic system according to the preceding embodiment, wherein the control unit is configured to regulate the flow of fluid by switching the loading pump.

S17. The fluidic system according to any of the preceding system embodiments, wherein the fluidic system further comprises a memory configured to at least store data.

S18. The fluidic system according to the preceding embodiment, wherein the memory is further configured to allow retrieval of data stored on it.

S19. The fluidic system according to any of the preceding system embodiments, wherein the fluidic system further comprises a valve downstream of the fluidic element configured to stop flow out of the fluidic element.

U1. Use of the fluidic system according to any of the preceding system embodiments in liquid chromatography, preferably in high performance liquid chromatography.

The invention will now be described with references to the accompanying drawings, which should only exemplify, but not limit, the scope of the present invention.

DETAILED DESCRIPTION OF EMBODIMENTS

Figure 1:
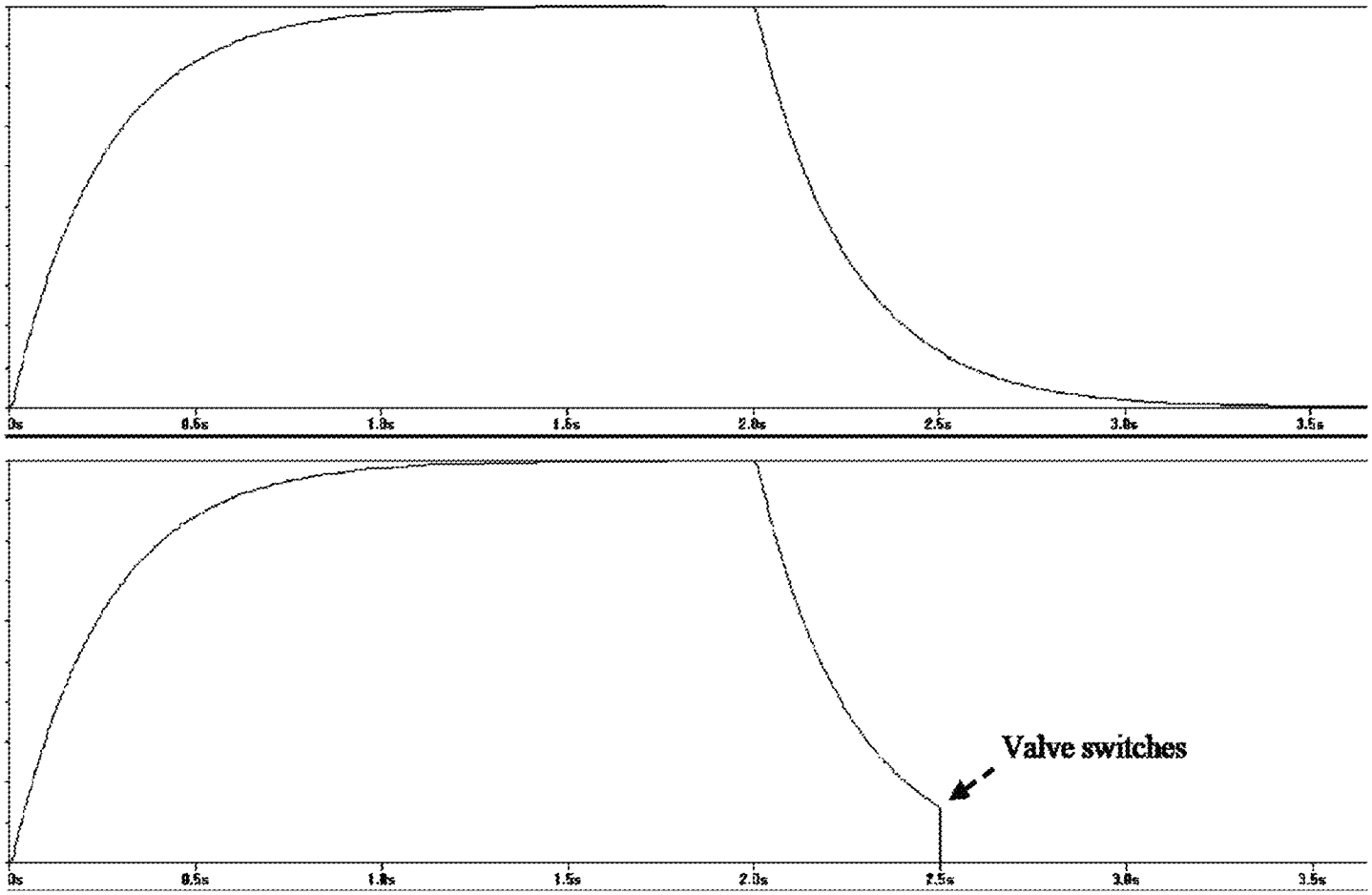
FIG. 1 depicts flow rate out of a fluidic element as a function of time.

FIG. 1 shows the flow rate of fluid being pumped by a loading pump 200 through a fluidic element 300 as a function of time for two different embodiments. An example embodiment of a fluidic system 10 that may be used to carry out different embodiments of the present technology is shown in FIGS. 5 to 13, where the loading pump 200 is a metering device that comprises a housing and a piston and two ports, and where the fluidic element 300 is a trap column. The fluidic system 10 may further comprise: a sample storage section 100, which is shown as a sample loop, a sample reservoir 120, a sample pick up means seat 140, a sample pick up means 160, which is shown as a sample pick up needle, an analytical pump 500, a separation column 400, a waste reservoir 700, a first solvent reservoir 910, a second solvent reservoir 920, a first distributor valve 620 comprising a plurality of ports and a plurality of connecting elements configured to changeably connect to the plurality of ports of the first distributor valve 620, wherein the plurality of ports of the first distributor valve 620 comprises a first port 601 directly fluidly connected to the seat 140, a second port 602 and a third port 603 that are both directly fluidly connected to the trap column 300, a fourth port 604 directly fluidly connected to the separation column 400, a fifth port 605 directly fluidly connected to the analytical pump 500, and a sixth port 606 directly fluidly connected to a second distributor valve 640, the second distributor valve 640 comprising a plurality of ports and a plurality of connecting elements configured to changeably connect to the plurality of ports of the second distributor valve 640, wherein the plurality of ports of the second distributor valve 640 comprises a seventh port 607 directly fluidly connected to the first distributor valve 620, an eighth port 608 directly fluidly connected to the waste 700, a ninth port 609 directly fluidly connected to the first solvent reservoir 910, a tenth port 610 directly fluidly connected to a pressure sensor 800, an eleventh port 611 directly fluidly connected to the second solvent reservoir 920, a pressure sensor 800, wherein the pressure sensor 800 is directly fluidly connected to the first port of the metering device 200, and the sample storage section 100 is directly fluidly connected to the second port of the metering device 200.

When an element is said to be directly fluidly connected to a port A of a distribution valve 620, 620 in the specification or in the claims, this denotes a connection between the respective port A and the element without there being another port of the same distribution valve being disposed between the port A and the respective element. For example, the trap column 300 is directly fluidly connected to ports 602 and 603 of distribution valve 620. It will be understood that, e.g., trap column 300 is also fluidly connected to the port 606. However, this fluid connection between the trap column 300 and the port 606 is via port 603, and is therefore not a direct fluid connection.

The fluidic system 10 may additionally comprise a control unit 820 that may control the loading process by controlling the loading pump 200, for example, based on the pressure sensed by the pressure sensor 800. For ease of illustration, the control unit 800 is only depicted in FIG. 5. However, it should be understood that this is for ease of illustration only and that the control unit 820 may in fact be present in all of the configurations depicted in FIGS. 5 to 13.

Each of the valves 620, 640 may be referred to as a distribution valve. Each valve may comprise a stator and a rotor, and a rotatable drive. The stator may comprise a plurality of ports, and the rotor may comprise connecting elements to connect the ports to one another. The rotor can be rotated with respect to the stator (by means of the rotatable drive) so that the connecting elements may establish connections between different ports. The rotatable drive can include a motor, gearbox and encoder.

In one embodiment, the pump 200 may be a metering device. The metering device may further comprise a housing and a piston. The metering device may also comprise a stepper motor or a drive device for moving the piston in the housing.

Figure 5:
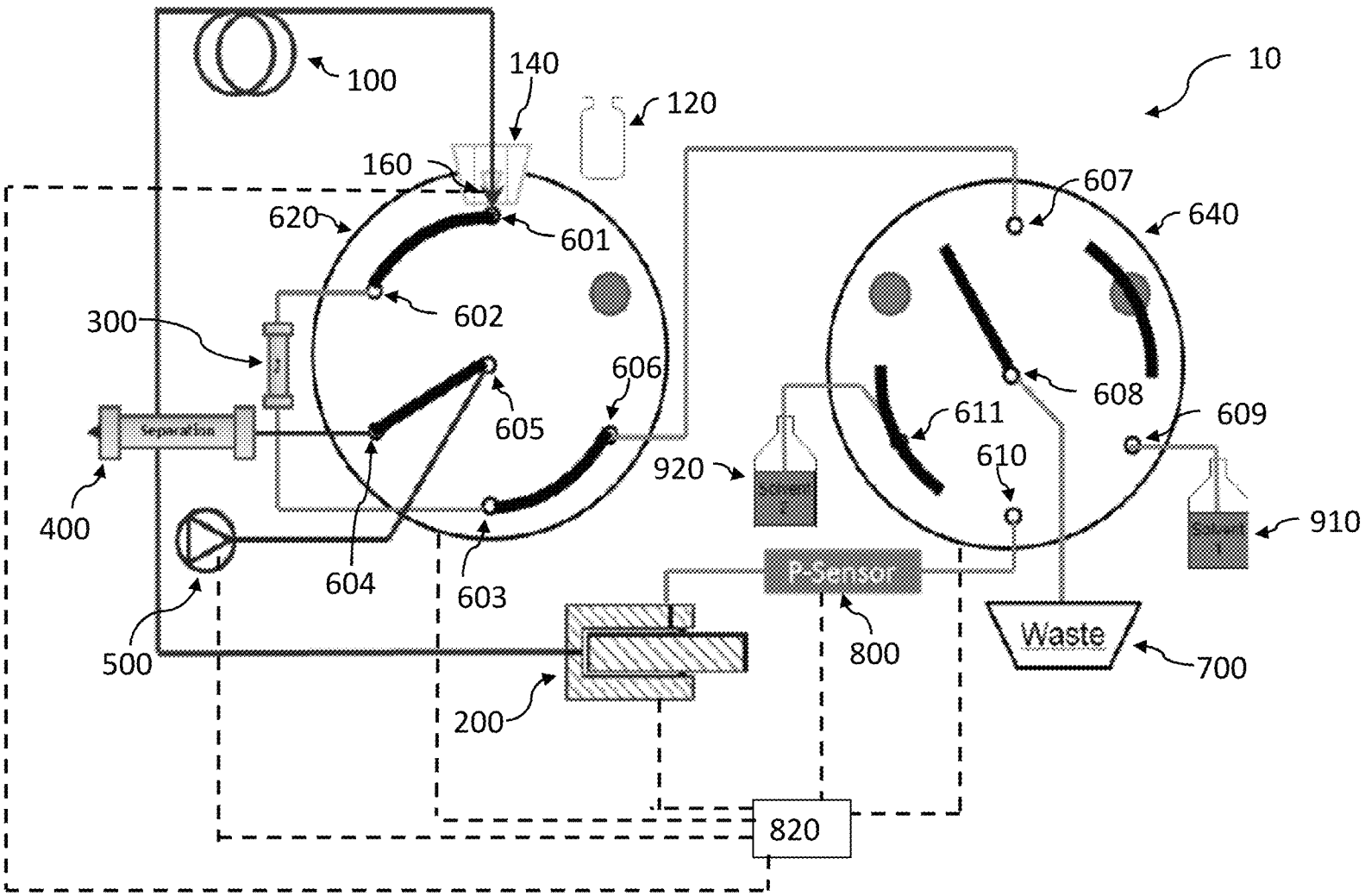
FIG. 5 depicts an exemplary fluidic system 10 in an idle mode.

The control unit 820 may also be referred to as controller 820, and the control unit 820 can be operatively connected to other components, as depicted by dashed lines in FIG. 5. More particularly, the controller 820 may be operatively connected to the distribution valves 620, 640 (and more particularly to the rotatable drives thereof), to the sample pick up means 160, to the analytical pump 500, and to the pump 200 (more particularly, to the stepper motor of the sampling device 200).

The controller 820 can include a data processing unit and may be configured to control the system and carry out particular method steps. The controller can send or receive electronic signals for instructions. The controller can also be referred to as a microprocessor. The controller can be contained on an integrated-circuit chip. The controller can include a processor with memory and associated circuits. A microprocessor is a computer processor that incorporates the functions of a central processing unit on a single integrated circuit (IC), or sometimes up to a plurality of integrated circuits, such as 8 integrated circuits. The microprocessor may be a multipurpose, clock driven, register based, digital integrated circuit that accepts binary data as input, processes it according to instructions stored in its memory and provides results (also in binary form) as output. Microprocessors may contain both combinational logic and sequential digital logic. Microprocessors operate on numbers and symbols represented in the binary number system.

Furthermore, it should be understood that in some embodiments, the system may be configured to measure pressure, e.g., by means of the pressure sensor 800. As depicted, the pressure sensor 800 may also be operatively connected to the controller 820, and the controller 820 may use readings of these pressure sensors when controlling the operation of the system. The pressure sensors may be configured to measure the pressure directly. However, it should be understood that also other parameters may be measured and may be used to determine the respective pressures (and that such a procedure should also be understood as a pressure measurement and the components involved should be understood as pressure sensors). For example, it will be understood that when the pump 200 supplies a solvent, the power consumption of the pump 200 will also depend on the pressure at which it operates—the higher the operating pressure, the higher the power consumption. Thus, e.g., the power consumption of the pump 800 may also be used to derive the pressure present at the pumps 800 Thus, the system 100 may generally be configured to measure pressures present at different locations of the system 10.

Figure 8:
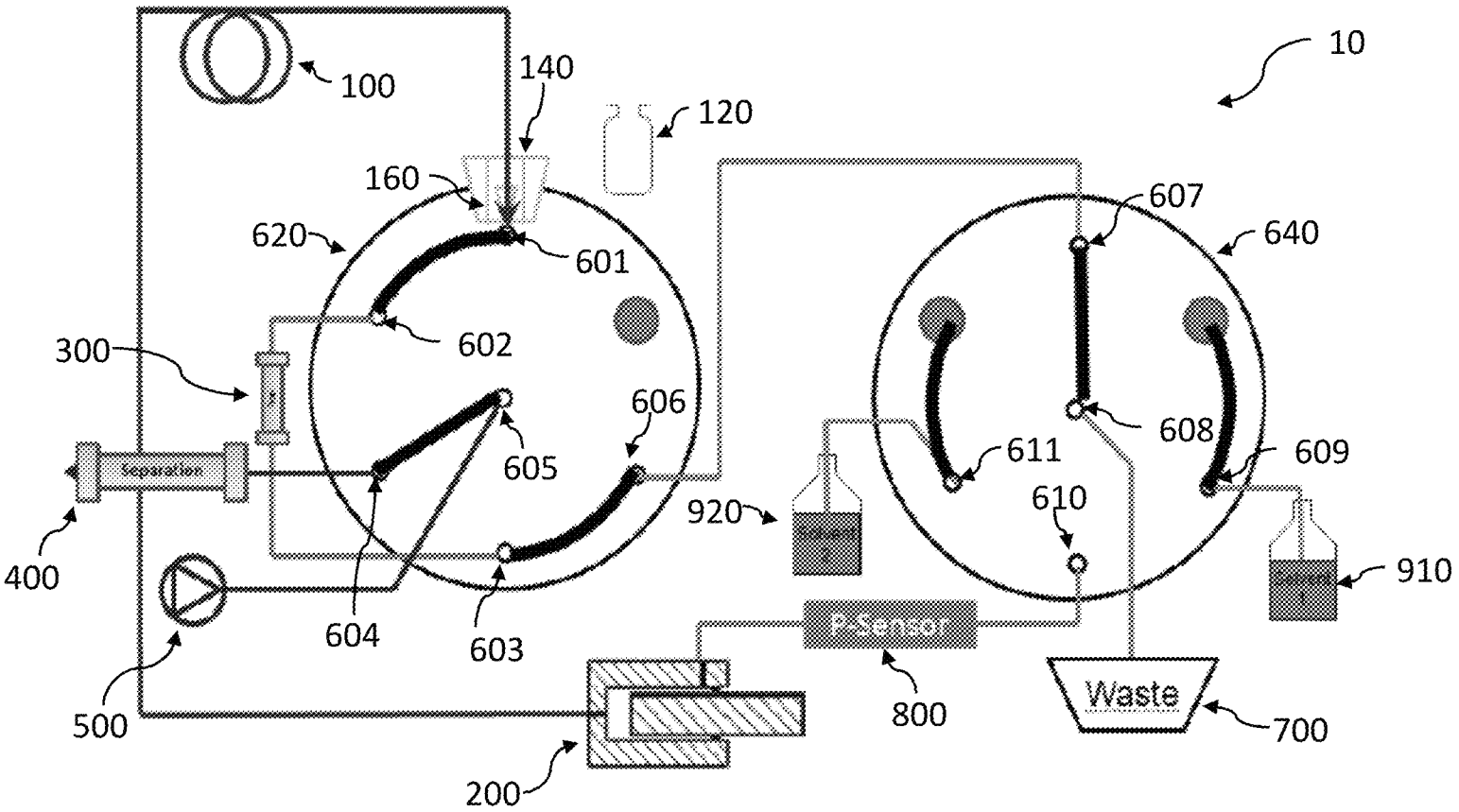
FIG. 8 depicts the exemplary fluidic system 10 in a sample loading mode.

In one embodiment, at a time $t_{start}$, the loading pump 200 may be switched to push fluid into the fluidic element 300 at a pressure $P_{load}$ exceeding an ambient pressure $P_{ambient}$—it will be understood that this may typically be performed while the system is in the configuration depicted in FIG. 8. This may cause fluid that may be stored in the pump to get compressed (see, for e.g., the interval marked $\Delta t_{lag}$ in FIGS. 4 (B) and 4(C)), and eventually start flowing into the fluidic element 300. The flow rate into the fluidic element is shown in FIG. 1. As fluid is compressed in the loading pump 200, the flow rate into the fluidic element 300 rises, until it reaches a maximum value, which depends on $P_{load}$. At a later time, the volume of the loading pump 200 may get exhausted and the pump may stop pushing fluid into the fluidic element 300. Nevertheless, the compressed fluid trickles out of the loading pump 200 and into the fluidic element 300 at (exponentially) decreasing flow rate. This is shown in the two panels of FIG. 1.

The loading pump 200 may be a continuous pumping pump that may be sophisticated and may require careful handling. On the other hand, it may be a non-continuous pump that may be limited in loading volume and so may resort to, possibly inaccurate, intermittent loading. Intermittent loading may have the disadvantage that the pressure increases during loading until the flow has become constant over the entire line. If a piston of the pump then stops because it is at the end of its travel, the flow slowly drops. This drop may take a long time but may be interrupted, for example, by switching a valve (see bottom panel of FIG. 1). That is, the bottom panel of FIG. 1, depicts an initial slow decrease of the flow into the fluid resistor (starting approximately at t=2.0 s) and then an immediate decrease caused, e.g., by switching of a valve, at t=2.55, which may result, e.g., in venting a portion upstream of the fluid resistor. With regard to the immediate decrease at t=2.55, the skilled person will understand that it is also not immediate in the strict mathematical sense, as the fluid will always have some inertia, such that even the switching of a valve does not lead to a reaction in no time (i.e., "immediately" in the strict sense). Further, also the pressure causing the flow will not change with an infinite slope. However, with regard to FIG. 1, the skilled person will understand that the change caused at t=2.55 occurs within a time range which is substantially (in this context: orders of magnitude) faster than the change caused at t=2.0 s, such that the change at t=2.55 may be considered as an immediate stop of flow into the resistor within the context of the present document.

This may have an adverse impact on the accuracy of the loading volume. For example, if the flow rate is not allowed to decrease on its own and the valve is switched, the volume of fluid actually flowing through the fluidic element 300, that may be a trap column, is smaller than the volume of fluid displaced by a piston of the loading pump 200. The volume that actually flowed (into the fluidic element 300 and out of the fluidic element 300) may vary from one loading process to the next and may be difficult to reproduce. Loading flows that vary from loading to loading may lead to varying retention times, which may be undesirable. Additionally, if the loading process is repeated several times, as in the case of interrupted loading with non-continuous pumps, the inaccuracies may add up.

Therefore, typically, chromatographic separation processes work with continuously pumping pumps or make use of limited loading volume. Continuously pumping pumps have the described inaccuracy only during pressure build-up and switching during flow. Here, too, the actual flow through the trap column is smaller than the assumed flow, but this effect may be neglected. Due to the repeated loading during interrupted loading with non-continuous pumps however, inaccuracies in both pressure build-up and degradation add up and may no longer be neglected. These inaccuracies may also limit the accuracy with which a sample can be positioned in a sample loop. Here too, the volume of fluid actually delivered to the fluidic element 300 may be of greater relevance that the volume displaced by the pump 200.

The Acquity UPLC System by Waters Corporation, Milford, MA, USA, for example, may avoid this problem by packing the sample in air cushions and detecting these cushions before the loop. However, air may be undesirable in chromatographic systems and may have its own disadvantages.

It may be advantageous to provide an exact loading volume, that may be larger than that of a piston stroke of a loading pump 300, for example, even with non-continuously pumping pumps. It may also be advantageous to reduce waiting times and to avoid the use of air cushions. According to an aspect of the present invention, this may be achieved by interrupting or reducing the undefined/unwanted loading flow in a controlled manner, for example after a piston of the loading pump 200 has moved to push fluid into the fluidic element 300.

To make this reproducible, a control unit 820 may be provided in the fluidic system 10 that may regulate the flow of fluid into the fluidic element 300. The loading flow or the loading pressure may additionally be measured with the help of a pressure sensor 800, for example, and may be fed back to the control unit 820, which may then regulate flow, to provide a feedback control of the loading process. This may also enable a sample plug to be reproducibly positioned in a sample loop via a pushed-loop method.

A controlled loading process, e.g., accounting for a compressibility of the fluid and any possible changes in the volume of the fluidic path, may be enabled by different embodiments. In a first embodiment, the flow may be measured by means of one or more sensors, which may measure pressure or flow. To be able to estimate or measure the flow, a flow sensor may be installed just before or just after the fluidic element 300, which may be a trap column. Likewise, a pressure sensor may be located somewhere on the high pressure side of the fluidic element 300. A combination would also be conceivable. In preferred embodiments, only a pressure sensor may be used to reduce the complexity of the fluidic system 10.

The actual amount of fluid that flows into the fluidic element 300 may then be determined by the integral of the pressure over time or may be measured directly with the flow sensor. The interruption of the flow (by, for e.g., switching of a valve) may now be possible at any time, since the flow has been measured (directly with the help of a flow sensor or indirectly with the help of a pressure sensor). In embodiments, a defined volume of fluid may be loaded into the fluidic element 300. In such embodiments, in order to achieve the defined loading volume, the loading process may then be repeated as often as necessary—until the calculated or measured volume matches the defined target volume. The measured volume may intermittently be fed back to the control unit 820, that may be configured to execute a control algorithm to control the volume of fluid delivered into the fluidic element 300 (feedback loop).

The loading pressure $P_{load}$ may strongly depend on the fluidic element 300 and its temperature. At low back pressures from the fluidic element 300, for example, the error may not be very strong without measurement; at higher back pressures, however, the effect becomes more pronounced. Since the loading pressure may vary from loading process to loading process due to different temperatures, the integral may be adapted to the respective loading process: in doing so, the maximum (steady-state) loading pressure $P_{load}$ may be set proportional to the loading flow promoted by the traverse speed of the piston.

In a second, alternate embodiment, the fluidic system 10 may not comprise elaborate pressure or flow sensors to determine the volume of fluid loaded into the fluidic element 300. Instead, a configuration of the loading pump 200 may be used to determine the volume of fluid loaded. This may be helpful in reducing the complexity of the system.

For example, in the embodiment shown in FIGS. 5 to 13, where a metering device 200 comprising a housing and a piston acts as the loading pump, after the travel to push fluid into the fluidic element 300 (which in this embodiment is a trap column), the piston may move back a bit, as the compressed fluid decompresses, until the pressure in front (i.e., upstream) of the fluidic element 300 (which is a trap column here) is approximately at ambient pressure. This may reduce the pressure in front of the fluidic element 300 and the flow may be reduced to a standstill. The piston position may now be used to determine the actual volume of fluid that has flowed into the fluidic element 300.

A pressure sensor 800 may also be installed somewhere on the pressure side of the fluidic element 300 for this embodiment. In this embodiment however, it may not need to measure the pressure continuously or be accurate as long as the zero point is correct, which allows the system 10 to use a very simple pressure sensor. The sensor 800 may just be switched to ambient pressure via a valve before the loading process, and the measured value may be stored. This value may be approached again when the pressure is reduced (reverse travel of the piston) and may then signal the completion of the loading process. Even if the piston is not driven all the way back to a standstill, this procedure may reduce the uncertainties in the flow. A combination of the described embodiments is also possible.

Positioning of a sample in a sample loop (which serves as the fluidic element 300 here) may also be done in the same way. It may be particularly advantageous to control the loading volume in this case. Typically, the fluidic path to the sample loop is known and thus, also the loading volume. The loading process may then be interrupted, while monitoring the already loaded volume using sensors until the loading volume is reached, as in one of the above embodiments. Or, according to another of the above embodiments, a piston of the loading pump 200 may be moved in such a way that the piston is in the position corresponding to the loading volume after the process. The piston may thus be moved briefly beyond the position corresponding to the piston's position indicating the correct positioning of the sample in the loop.

As discussed before, typical loading processes may not be efficient and/or reproducible and may not allow for delivery of accurate loading volumes. In addition, little diagnostic information specific to the loading process may be available. Thus, issues occurring during the loading may be detected very late in an analytical workflow. This may compromise reliability of the chromatographic workflow and complicate usability with potentially high level of expertise needed during the process and complex troubleshooting.

Generally, fluidic elements, such as a trap column 300, can be loaded in different ways.

One way to load a fluidic element (i.e., to have an amount of liquid flowing into the element, where it will be appreciated that typically, the same amount of liquid will also flow out of the element) is referred to as flow-controlled loading.

For example, loading of a sample to the analytical column may typically occur flow-controlled. Thus, the sample is delivered to the column at a set constant flow rate $f_{load}$. For example, the pressure may then be set in such a manner that the flow rate is achieved. Hence, loading is completed after a time $t_{load}$ when the volume $V_{load}$ has been delivered, where $$t_{load}=V_{load}/f_{load}.$$

The benefit of this loading approach is that the time required for loading is predictive and thus well-plannable. Therefore, it may be widely employed. However, flow-controlled loading may have several drawbacks.

It may be inefficient: frequently loading could be significantly accelerated if the entire flow/pressure footprint of the chromatography system would be employed. In other words, in flow controlled loading, the flow is set, e.g., to 1 ml/min (though this is a mere example), and in response to this, the pump operates at a pressure of, e.g., 100 bar. If it is desired that 1 ml is used for loading, this loading would take 60 s. However, it may also be possible to operate the system at much higher pressures, e.g., at a pressure of 1,000 bar. If such a high pressure was used, a higher flow of, e.g., 10 ml/min could in principle also be achieved, such that the loading would already be achieved in 6 s. Thus, by having a flow controlled loading, the system may in some instances be operated at pressures substantially below the pressure at which the system could in principle be operated, thus resulting in a longer time for the sample loading than would in fact be necessary.

Furthermore, flow-controlled loading may be inaccurate: if the loading parameters are not chosen adequately, the effectively loaded volume can differ significantly from the expected volume. Particularly at elevated pressures this may be related to the compressibility of fluids. It will be understood that a significant amount of energy may be consumed by compressing fluids at the cost of energy available for delivery of the volume.

Flow-controlled loading may also be error-prone: In addition to the afore mentioned issues related to inadequate loading parameters, presence of air or changes to the backpressure of the trap column are typically not detected and thus can have immediate adverse effects on the loading performance. For instance, if the backpressure of the trap column increases e.g. through accumulation of particulate matter from the sample, the pressure may need to be increased to maintain constant flow loading. This can cause an abort of the loading process if a critical pressure level is reached, can cause damage to the chromatography system or can compromise the chromatography performance.

Another way to load a fluidic element (e.g., a trap column) is referred to as pressure-controlled loading.

Pressure-controlled loading achieves loading at a constant pressure. That is, a pressure is set and the pump(s) are operated at a flow rate resulting at the set pressure. Thereby, the loading volume $V_{load}$ is measured either using flow sensors or by the volumetric displacement (i.e. position of a pump piston). Thus, the loading flow varies depending on the backpressure of the fluidic system, particularly the backpressure of the trap column. As a consequence, the time for loading $t_{load}$ varies accordingly:

$$t_{load}=V_{load}/f_{load}.$$

This may be considered during planning of the chromatography workflow, as there is no constant time for loading when, for example, wishing to achieve a defined loading volume.

However, pressure-controlled loading has several advantages over flow-controlled loading. In particular, it may be more efficient, as loading can be performed at the maximum pressure of the fluidic system (similar to the considerations provided above). Additionally, it may be more robust, as an increase in back pressure of the trap column does not cause over-pressure events. Thus, sample runs are not aborted. Nonetheless, loading at an increased backpressure would take longer as the loading flow is reduced accordingly.

Currently, pressure-controlled loading is rarely employed. One example is the ThermoFisher EASY-nLC nano HPLC system. A drawback of the loading mechanism of the EASY-nLC is that the volume measurement is not very accurate. It is assumed that loading starts once the loading pressure has been established. However, already during pressurization (i.e., while the pressure is increased to the loading pressure), a flow is delivered through the column. Thus, the actual loaded volume is larger than the intended (set) loading volume. Moreover, this discrepancy is dependent on the loading pressure, the compressibility of the fluid and the volume of the conduit which needs to be compressed. In addition, the EASY-nLC lacks additional diagnostic monitoring capabilities to enhance the robustness and reproducibility of the loading process.

In embodiments of the present technology, fast loading is achieved through pressure-controlled loading at high pressure conditions, e.g., at the maximum operating conditions (typically the maximum pressure rating) of the fluidic system for maximum efficiency.

Accuracy and precision may be achieved by a loading control algorithm which takes volume losses during loading due to compressibility of the fluids, volume expansion of the fluidic system into account. When the present technology is employed in an LC system, towards the end of the loading procedure, which may be performed in (constant) pressure-controlled mode, a smooth transition to an ambient or analytical pressure may be achieved.

Additionally, the loading control mechanism may also provide means for diagnostics of the loading process such as incorrect fluid, separation column, fluidic connections or leakages.

Further, monitoring capabilities for assessing the loading process and assisting with troubleshooting in case of issues may also be provided by the loading control algorithm. In preferred embodiments, this may be achieved without additional, elaborate flow sensors for measuring the loaded volume. Thus, the loaded volume may be accurately delivered using signals from a pressure sensor only.

In embodiments of the present technology, the compressibility of the fluid(s) is considered for accurate delivery of a compressible fluid volume across a fluidic element. It should be understood that whenever such a fluid is displaced from a stationary state, work is consumed for compression which results in pressure building up in the conduit upstream of the fluidic element.

Figure 2:
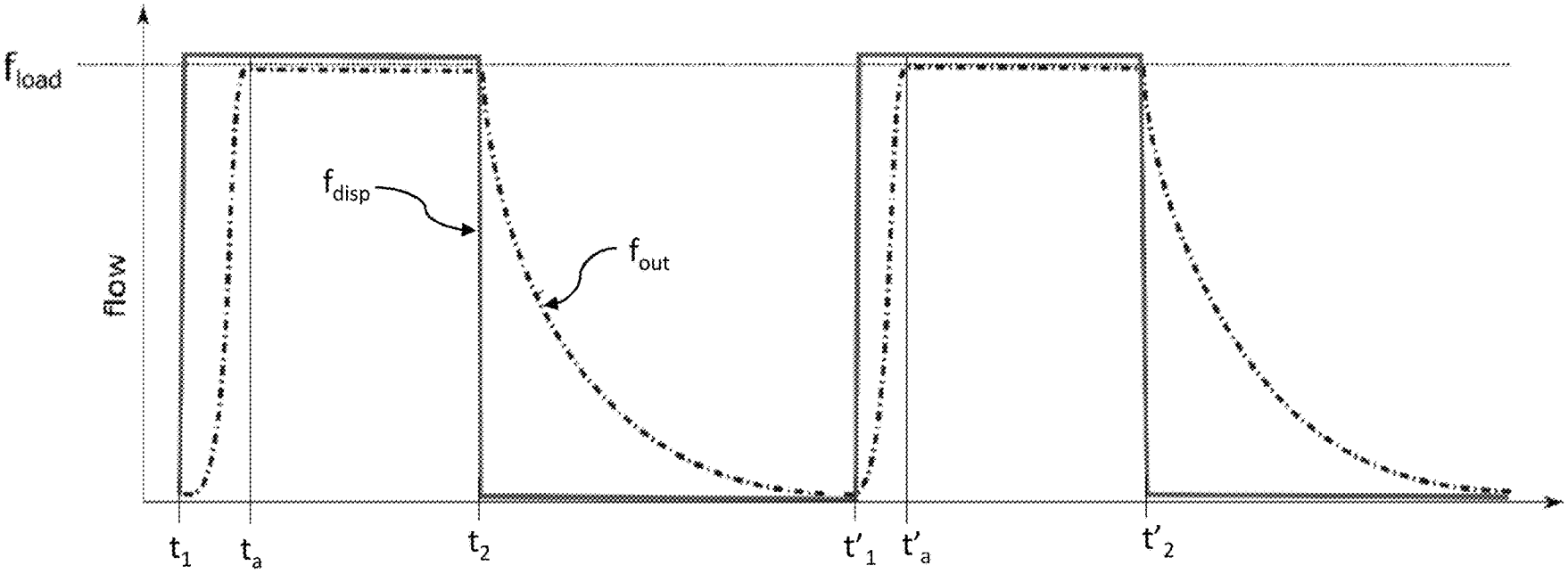
FIG. 2 depicts flow signals as a function of time.

FIG. 2 depicts volume flows in a fluidic system 10 as the one depicted in FIGS. 5 to 13 as a function of time. More particularly, FIG. 2 includes two curves and, one relating to a displacement flow $f_{disp}$ and the other relating to a flow $f_{out}$ actually delivered through the fluidic element (e.g., the trap column 300). Consider that at the beginning, there is no flow and no pressure provided by the pump (see 200 in FIG. 5), and the pump 200 starts operating at time $t_1$ in a flow controlled manner, and stops its operation again at time $t_2$.

In the time interval defined by $t_1$ and $t_2$, there will thus be a constant displacement flow $f_{disp}$. However, this will not fully correspond to the flow through the fluidic element 300. Instead, when the pump 200 starts operating, the fluid upstream of the fluidic element 300 will be compressed, and this compression accounts for the difference between the displacement flow $f_{disp}$ of the pump and the actual flow $f_{out}$ through the fluidic element 300. At some time (indicated by $t_a$), the pressure upstream of the fluidic element 300 will be so high that the flow through the resistor $f_{out}$ is substantially equal to the displacement flow $f_{disp}$, and thus, an equilibrium is reached.

Further consider that at time $t_2$, the flow is switched off, such that no further fluid flow is provided by the pump, i.e., $f_{disp}$ becomes 0. However, as at $t_2$, the fluid upstream of the fluidic element 300 is still pressurized, there is still flow through the resistor $f_{out}$. The more fluid flows through and out of the resistor, the smaller the pressure in the section upstream of the fluidic element 300. Thus, this flow $f_{out}$ decreases (exponentially) until there is no more excess pressure upstream of the resistor. The respective process can then also be repeated, as indicated by times $t_1'$, $t_a'$, $t_2'$ corresponding to times $t_1$, $t_a$, $t_2$ discussed before.

As a result, the volume displacement flow $f_{disp}$ of the fluid upstream of the fluidic element 300 is larger than the corresponding flow $f_{load}$ through the fluidic element 300 (and thus downstream of the fluidic element) in the interval defined by $t_1$ and $t_a$. This discrepancy between $f_{disp}$ and $f_{load}$ vanishes once an equilibrium state is reached (at time $t_a$). Then the pressure is constant and corresponds to the back-pressure value for the given flow rate $f_{disp}$. Now $f_{disp}=f_{load}$ (see FIG. 2). The difference in the respective volumes $V_{disp}$ and $V_{load}$ that were displaced and loaded during this phase is the compression volume $V_{comp}$. Hence, $V_{comp}$ can be determined by pressurizing the system against a blocked outlet, i.e., $f_{load}=0$.

Once the actuation of the fluid is stopped, i.e., $f_{disp}=0$ (see $t_2$), no additional energy is added to the system. The energy which is stored in the compressed fluid is released through an exponentially decreasing flow $f_{out}$ through the fluidic element 300. The volume which is delivered during this last phase is identical to the compression volume $V_{comp}$ that initially compressed the system. Hence, the loaded volume is equivalent to the displaced volume.

In this process the duration for compression/decompression depends on the volume of the conduit/fluid which is compressed, the compressibility as well as the fluidic resistance. It will be understood that this is analogous to charging/discharging of a capacitor in line with a resistor in an electric circuitry.

Thus, depending on the volume and the fluidic resistance the periods for compression and decompression can contribute significantly to the overall duration of the loading procedure. Particularly the decompression phase may be time-limiting as compression can occur rather quickly with adequate fluidic actuation. In the following an approach to accurate but yet fast loading and thus decompression is presented.

The periods for compression and decompression may become particularly relevant in cases where loading occurs iteratively, such as in the case of fluidic actuation with a metering device (e.g., a syringe pump) as the loading pump 200 (see FIG. 3; also see below). Such pumps can deliver only a limited volume of fluid and then need to be refilled. During each such loading cycle, time is consumed for decompression. Hence, it may be particularly advantageous in these cases to shorten the decompression phase.

Figure 3:
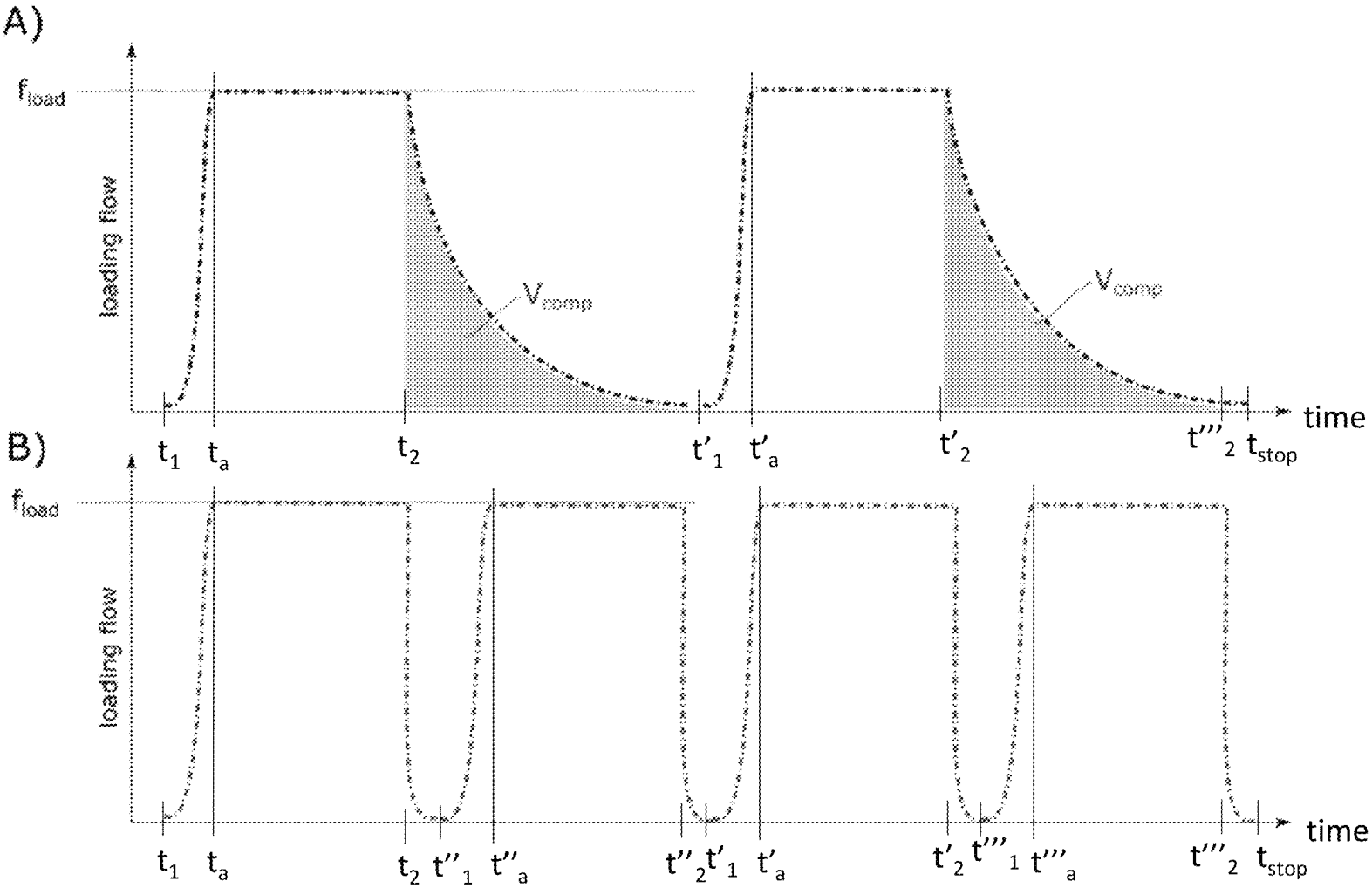
FIG. 3 depicts flow signals as a function of time with and without active decompression.

FIG. 3 depicts the loading flow rate into a fluidic element 300 as a function of time, for two embodiments of the present technology. The top panel shows the loading flow rate as a function of time in an embodiment where no active decompression occurs (similar to FIG. 2). The bottom panel shows the same in an embodiment where the fluid is actively decompressed. In both these embodiments, fluid is loaded into the fluidic element 300 by a loading pump 200 as in FIG. 2. At a time $t_1$, the loading pump is switched to a loading pressure $P_{load}$ from an ambient pressure $P_{ambient}$, followed by switching the loading pump to the ambient pressure $P_{ambient}$ again at a time $t_2$ later than $t_1$. This causes fluid to get compressed in the loading pump 200 and eventually to flow into the fluidic element 300. The flow rate of fluid into the fluidic element rises gradually from zero to a maximum value, which depends on the loading pressure $P_{load}$ among other things, at the time $t_a$. Once the loading pressure is switched to ambient pressure $P_{ambient}$ again at $t_2$, the flow rate decays exponentially as the compressed fluid flows into the fluidic element 300, as was described before with reference to FIG. 2.

In absence of any means of determining the volume of fluid delivered into the fluidic element 300 until the time $t_2$, the fluid may have to be allowed to decompress completely in order to ensure an accurate volume of fluid loaded into the fluidic element 300. In this case, the loaded volume would be identical to the volume of fluid displaced by the loading pump 200.

In one embodiment, without any additional means provided for decompression, the process of decompression may take a long time and render the separation process inefficient. For example, as shown in FIG. 3(A) the decompression process may last until a time $t'_1$, where the time interval for decompression ($t'_1$-$t_2$) may be larger than the time interval for compression ($t_a$-$t_1$). A subsequent loading cycle may then be started at the time $t'_1$.

In another embodiment, the fluid may be actively decompressed, e.g., by negative displacement of a piston of the loading pump 200 and thereby reducing the pressure, at the time $t_2$. This may allow for a faster cycle time for iterative loading. This is shown in FIG. 3(B), where, in the time that it takes to carry out two loading cycles without active decompression, ($t_{stop}$-$t_1$) (see FIG. 3), four loading cycles may be carried out with active decompression. The time for decompression, ($t''_1$-$t_2$), in this case may be significantly shorter than that without active decompression, ($t'_1$-$t_2$), and may be similar to the time for compression, ($t_a$—$t_1$). Thus, the overall time for the loading process may be reduced.

However, such active decompression may imply that the displaced volume is no longer equivalent to the loaded volume at the end of a loading cycle. In particular, additional means, such as flow rate or pressure sensors for determination of the loaded volume, $V_{load}$, may be employed to ensure an accurate loading volume. It may be further preferable to employ only pressure sensors and make use of pressure measurements to allow delivery of accurate loading volumes, to reduce the complexity of the fluidic system 10.

This is addressed by the embodiments described herein, where the actual loaded volume may be determined by calculating the volume contribution due to compression of fluids and expansion of the fluidic system. Further, this approach may not need a flow sensing device for accurate loading volume calculation. It may be solely implemented with a pressure sensing device. Moreover, diagnostic parameters which allow for monitoring the loading process to achieve consistent and accurate results may be measured.

To allow for accurate loading of volumes to a fluidic element (e.g., a trap column), the compressibility of the fluid(s) as well as the expansion (elasticity) of the fluidic system (conduits) may be taken into account. For simplicity, those are referred to as compression volume in the following. Determination of the compression volume, due to the loading pressure Road, for a given fluidic setup (conduits, trap column, fluid(s)) may be carried out by one of the following approaches.

Determination of the compression volume for a given fluidic setup and a given pressure may be done experimentally. To do this, a series of measurements may be performed. The fluidic setup may be blocked at the outlet, preferably an outlet of the fluidic element 300, and the loading pump 200 operated to pressurize the fluid flow path to different pressures. In embodiments, only the outlet of the loading pump 200 may be blocked. In this case, however, any changes to the volume of the fluidic element 300 would not be accounted for and may lead to inaccuracies in the loaded volume.

Then, for each pressure setpoint the displaced volume which is required for pressurization may be determined. In embodiments, the displaced volume may be measured with the help of a volume or flow rate sensor. In preferred embodiments, however, where a flow rate or volume sensor may not be employed, it may be measured, for example, from the difference in piston positions before and after pressurization for a loading pump 200 that may comprise a piston.

A relation between pressure and compression volume may then be determined mathematically (e.g., by linear regression fitting though other variants are possible) and stored in a system (e.g., in a firmware). Alternatively, a data processing means may be provided which may allow access to this data. Further alternatively, such data may be stored in a cloud server and may be accessed on-demand.

Determination of the compression volume for a given fluidic setup and a given pressure may also be done by calculation. To do this, one or more of the following parameters may be taken into account: a total volume of the fluidic conduits which may be pressurized to $P_{load}$ during the loading process, a compressibility of the fluid(s), an elasticity of the fluidic conduits, or an elasticity of the piston seals when the loading pump 200 comprises a piston. It may also be beneficial to employ a combination of these means for obtaining a nominal compression volume.

Measuring the compression volume experimentally may assure that all actual fluidic effects of a given loading flow path are considered. However, such a measurement may be needed for each fluid that may be loaded into the fluidic element 300, which may be inefficient. To improve the measurement efficiency, one could only measure the compression value for one (or a few) representative fluid(s) and calculate the compression volume for a different fluid by accounting for the difference in fluid compressibility.

Figure 4:
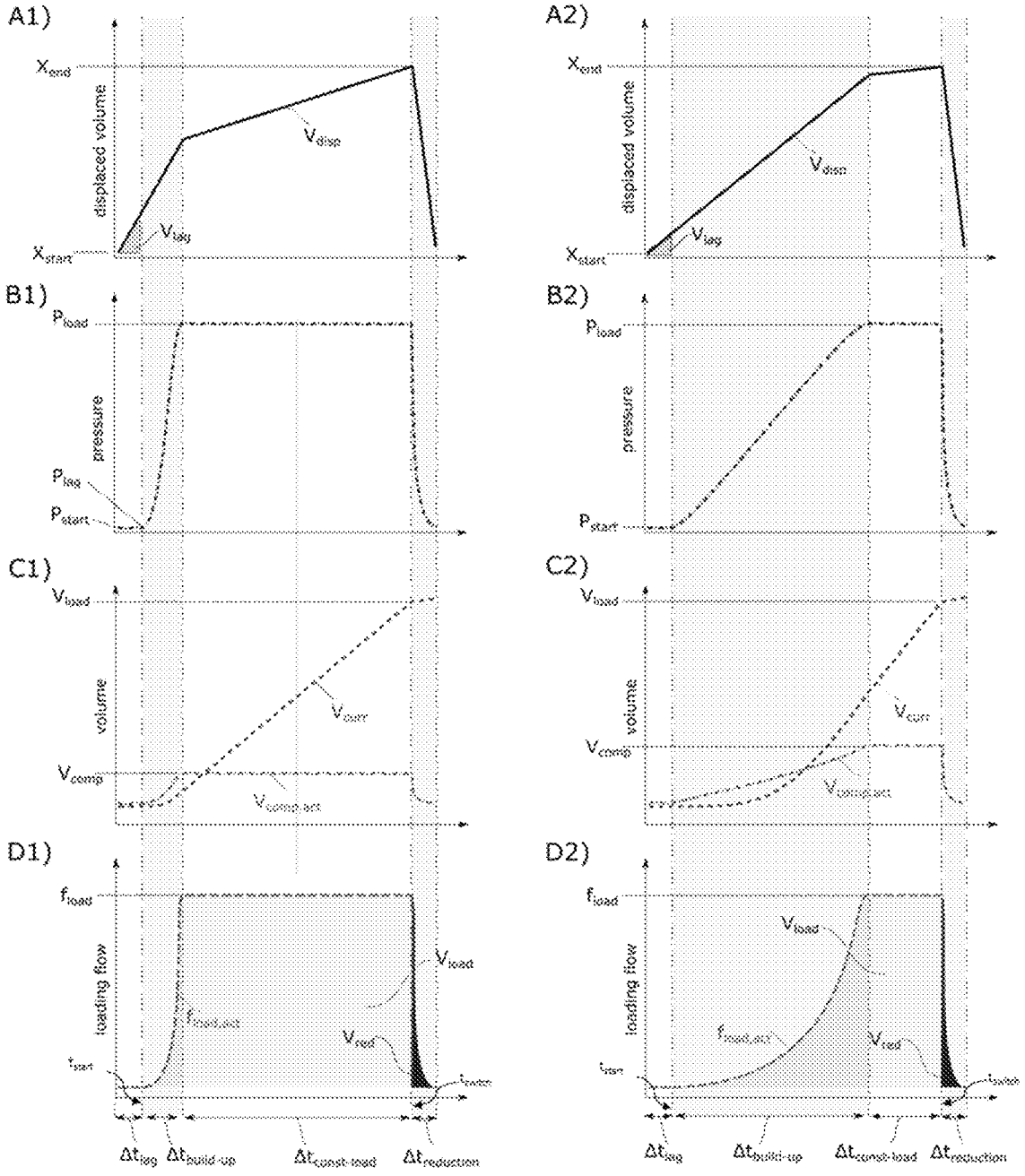
FIG. 4 depicts displaced volume, pressure, loaded volume, and loading flow rate signals as a function of time.

FIG. 4 depicts one embodiment of the method according to one aspect of the present invention and different parameters that may help to monitor the loading process. It may be appreciated that these represent only an exemplary subset of parameters that may be employed to monitor the loading process and in no way constitute an exclusive set. Additionally, while FIG. 4 depicts flow rates (FIG. 4(D)) and flow volumes (FIG. 4(C)) as well, in preferred embodiments of the present technology only pressure sensors may be used. These may be used to sense a pressure in the loading pump 200 or between the loading pump 200 and the fluidic element 300. This is depicted in FIG. 4(B). FIG. 4(A) depicts the volume of fluid displaced by the loading pump 200, which may be obtained by using the position of a piston of the pump 200, for example.

The loading process according to the embodiment shown in FIG. 4 may comprise different steps. A first initialization step may comprise specifying the fluid (that may be a solvent) for loading, for e.g., from a drop-down list in a data processing means or cloud server, to assure that the correct nominal compression volume may be calculated. Following that, the loading pump 200 may be filled with the specified fluid and a start position of the fluidic actuator, for e.g. a piston, may be determined. This position $X_{start}$ may be used as a reference to facilitate calculation of the loaded volume at different points of time in the subsequent steps. For a cylindrical piston of the loading pump 200 for example, the loaded volume at a time t is $V(t)=(X(t)-X_{start})*r^2*$, where r is the radius of the piston, and where X(t) is the position of the piston at the time t. A starting pressure value, $P_{start}$, may also be determined, for which a pressure sensor may be employed. It represents the pressure in an idle mode when the loading flow path is not pressurized, for e.g., it may be at ambient pressure, $P_{start}=P_{ambient}$. The loading process may now be started.

The actual loading process may comprise an initial phase, that may be called 'determination of the lag volume $V_{lag}$', wherein $V_{lag}$ is a diagnostic parameter. $V_{lag}$ may indicate if the loading flow path is filled with the correct solvent and is sufficiently tight, i.e., it is not filled with air. $V_{lag}$ may be determined as the volume to pressurize the loading flow from a starting pressure, $P_{start}$, to a slightly higher pressure, $P_{lag}$, such that $P_{lag}=P_{start}+\Delta p$. Typically, a small increase $\Delta p$ is sufficient, e.g., 1 bar. This phase is indicated by the time interval $\Delta t_{lag}$ in FIG. 4. Note that no fluid may flow into the fluidic element 300 during this phase, as indicated by the loading flow rate in FIG. 4(D), as well as the currently loaded volume indicated by the curve labeled '$V_{curr}$' in FIG. 4(C). However, the volume of fluid displaced by a piston of the loading pump 200, for example, may not be zero, as indicated by the shaded region marked '$V_{lag}$' in FIG. 4 (A). This represents the volume of fluid compressed due to the increase $\Delta p$ in pressure.

During the loading the piston of the loading pump is moving forward (X(t) is increasing, see FIG. 4(A)). This volume displacement results in a compression of the fluid (that may be a solvent) in the loading flow path and an increase in pressure. This increase in pressure relative to the displacement, $X(t)-X_{start}$, is dependent on the compressibility of the fluid. A highly compressible fluid, for example, would exhibit a larger displacement, whereas a less compressible fluid would exhibit a smaller displacement for the same increase in pressure.

If a fluid with significantly lower compressibility, such as air, is contained in the loading flow path the displacement, $X(t)-X_{start}$, and correspondingly $V_{lag}$, to compress the system to a given pressure P is significantly enlarged compared to a fluid (that may be a solvent) without presence of air. Similarly, a leakage would prevent/counteract the pressure build-up, and would result in a higher $V_{lag}$.

Thus, $V_{lag}$ may allow identification of the presence of air, for e.g., through failure to refill loading solvent bottles or an empty sample vial, as well as leakages of the loading flow path. This phase is depicted in FIG. 4(A).

Determination of $V_{lag}$ may be followed by a pressure build-up phase, indicated by the time interval $\Delta t_{build\text{-}up}$ in FIG. 4. Pressure may be built up from a value $P_{start}+\Delta p$ to a loading pressure $P_{load}$, that is higher than $P_{start}$, until either a defined loading volume $V_{load}$ has been loaded or the loading pressure $P_{load}$ is reached.

The first condition may be fulfilled when the currently loaded volume $V_{curr}$ equals $V_{load}$, after accounting for the volume 'losses' due to compression of the loading flow path, i.e., the nominal compression volume $V_{comp,nom}$ at the given pressure P, $V_{curr}=V_{load}+V_{comp,nom}(P)$. Since $V_{load}$ has been loaded already during pressure build-up, the loading is completed and a constant pressure loading phase following the pressure build-up phase may be omitted. Note that $V_{comp,nom}(P)$ is an increasing function of the pressure P. The nominal compression volume at a given pressure P may be retrieved from a data processing means (for example, a look up table in firmware or in a computer storage system) or a cloud server. This may ensure that an accurate determination of the actual loaded volume is being made at any given pressure P.

FIG. 4(C) additionally shows the volume of fluid actually compressed with the curve labeled '$V_{comp,act}$'. $V_{comp,act}$ is an increasing function of pressure until it saturates out to a maximum compression volume, $V_{comp}$, at the loading pressure, $P_{load}$ (see FIG. 4(C)). This is also reflected in the changing slope of the curve labeled '$V_{disp}$' in FIG. 4 (A), which represents the rate at which fluid is displaced by, for e.g., a piston of the loading pump 200, where once the loading pressure reaches $P_{load}$ at the end of the build-up phase, the slope decreases (though the sign remains the same, indicating advance of the piston, for example). This difference in slopes of the rate at which fluid is displaced may also be used to determine the maximum compression volume, $V_{comp}$.

In case the defined loading volume $V_{load}$ is not reached during the pressure build-up phase, pressure is built-up until $P_{load}$ is reached. The actual compression volume $V_{comp,act}$ may then be determined. Analogously to $V_{lag}$, $V_{comp,act}$ may be obtained as the piston movement relative to $X_{start}$ which is needed to pressurize the loading flow path from $P_{start}$ to $P_{load}$. Likewise, $V_{comp,act}$ is a diagnostic parameter that may be indicative of the compressibility and tightness of the loading flow path. This phase is depicted in FIG. 4.

A constant pressure loading phase, indicated by the interval $\Delta t_{const\text{-}load}$, may follow the pressure build-up phase. Once $P_{load}$ has been reached, loading may be continued at constant pressure $P=P_{load}$ until either the currently loaded volume $V_{curr}$ is equal to $V_{load}$, or the volume of the loading pump 200 has been depleted. The latter case may arise when the loading pump 200 is a syringe pump, for example, and the solvent volume in the pump $V_{pump}$ is lower than the loading volume $V_{load}$ plus the volume contributions for compression, $V_{comp}$, i.e., $V_{pump}<V_{load}+V_{comp}$. In this case, the loading may need to occur iteratively with intermittent refills of the pump 200. During the constant pressure loading phase the actual flow rate $f_{load,act}$ which is delivered through the trap column may be equal to a nominal, i.e., set, loading flow rate $f_{load}$. This phase is depicted in FIG. 4(D), where the actual flow rate is depicted by the long dashed curve labeled '$f_{load,act}$', and a set loading flow rate is depicted with short dashes and labeled '$f_{load}$'.

The constant pressure loading phase may be followed by a pressure reduction phase, indicated by the time interval $\Delta t_{reduction}$ in FIG. 4. The pressure is reduced from the loading pressure $P_{load}$ to the ambient pressure $P_{ambient}$ (which may be equal to $P_{start}$) at the time labeled $t_{switch}$ in FIG. 4. This reduction may typically occur rather quickly to allow for fast turnaround cycles for iterative loading, for e.g., when the volume of the loading pump 200 satisfies the condition $V_{pump}<V_{load}+V_{comp,act}$. This phase may become relevant in the case of intermittent loading when the volume of the loading pump has been depleted and a refill is used for an additional loading iteration. This phase is depicted in FIG. 4(D).

During this phase, the compressed volume $V_{comp,act}$ is reduced to zero and the currently loaded volume $V_{curr}$ increases (see FIG. 4(C)). The volume loaded in this phase may be denoted the volume loaded during pressure reduction $V_{red}$. That is, $V_{red}$ is the volume of fluid delivered through the fluidic element 300 in this phase, that may be a trap column. This is shown in FIG. 4. (D) as the shaded region labeled '$V_{red}$'. Typically, this volume contribution is much lower than $V_{load}$. Hence, it may be neglected—also see FIG. 4(C), where the additional volume loaded after $t_{switch}$ is relatively low and neglected, as $V_{load}$ is here denoted as the volume loaded at $t_{switch}$. Nonetheless, $V_{red}$ may also be determined for greater accuracy, such that $V_{load}$ also includes $V_{red}$. This may be done, e.g., if the fluidic resistance, $R_{trap}$, of the fluidic element 300, which may be a trap column (or another fluidic resistance), is known. The latter may be determined during the constant pressure loading phase, preferably towards the end of the constant pressure loading phase, as $R_{trap}=P_{load}/f_{load}$.

$V_{red}$ may then be obtained by integrating the flow $f_{red}$ which runs through the fluidic element 300, that may be a trap column, during the depressurization, where $f_{red}(P_{current})=P_{current}/R_{trap}=P_{current}/P_{load}*f_{load}$. Hence, $V_{red}$ may be obtained as $$V_{red} = \int_{t_{switch}}^{t_{switch}+\Delta t_{reduction}} f_{load} \cdot \frac{P_{current}(t)}{P_{load}} dt.$$

Note that $f_{red}$ is a function of the pressure at a location upstream of the fluidic element 300 which decreases continuously due to decompression of the fluid, that may be aided by an active decompression of the loading pump 200. In the above, it has been assumed that the trap resistance, $R_{trap}$, does not vary significantly during the pressure reduction phase. As may be appreciated by a person skilled in the art, different assumptions may be employed for $R_{trap}$ for the same purpose. For example, it may be possible to experimentally determine the resistance $R_{trap}$ for different pressure values, and this variation may instead be used.

Thus, after completion of a loading iteration indexed by i, for example, the volume which remains to be loaded in the subsequent iteration i+1 is $V_{remain}=V_{load}-V_{loaded_i}-V_{red}$, where $V_{remain}$ is the remaining volume, $V_{loaded_i}$ is the volume that was loaded during iteration i. In the case when loading has been completed (i.e., $V_{remain}=0$), typically additional flow $f_{red}$ may be prevented by switching a valve downstream of the fluidic element 300, that may be a trap column, to a blocked state. A subsequent precompression of the fluidic element 300, that may be a trap column, for pressure alignment prior to switching the fluidic element 300 in-line with the analytical column may then be carried out. Hence, here $V_{red}=0$, as the pressure is typically not reduced to ambient pressure prior to such a pressure alignment.

To complete the loading process, the pressure may also be reduced to ambient pressure. This reduction may occur rather quickly to prevent additional flow across the fluidic element 300 which would result in a larger than intended loading volume.

The loading process according to one embodiment of the present technology is illustrated in FIG. 4. It shows the relevant processes and phases for two different cases. The panels on the left ((A1) to (D1)) represent loading of a fluidic element 300, that may be a trap column, with a high flow resistance and low internal volume. Thus, the pressure build-up phase, $\Delta t_{build\text{-}up}$, is short.

On the right side of FIG. 4 ((A2) to (D2)) the analogous case for loading of a fluidic element 300 with relatively high backpressure but also a high internal volume is illustrated. Here, the build-up phase $\Delta t_{build\text{-}up}$ is significantly longer, since the loading pump 200 may be operated at a higher pressure to attain the loading pressure $P_{load}$, compared to the case on the left. Hence, in this case the volume for compression may be a significant fraction of the overall displaced volume.

FIGS. 5 to 13 depict one possible configuration of the fluidic system 10 that may be used to carry out embodiments of the present invention. Reference will now be made to these figures.

For loading a sample into a pushed loop, the trap column 300 may be replaced, in embodiments, by the loop in which the sample is to be loaded.

FIG. 5 shows the fluidic system 10 in the idle position: the flow of the analytical pump 500 is directed through the first valve 620 directly to the separation column 400. The needle 160 is in the needle seat 140, while the second valve 640 (for ease of reference, the second valve 640 may also be referred to as the right valve 640) responsible for the selection of the trap solvents 910, 920 and for providing a compress position. The valve 640 is currently in a compress position. Note that in this compress position the fluidic path comprising the sample loop 100, and the trap column 300 may be pressurized as the outlet of this path is blocked by a dead port on the right valve 640.

Figure 6:
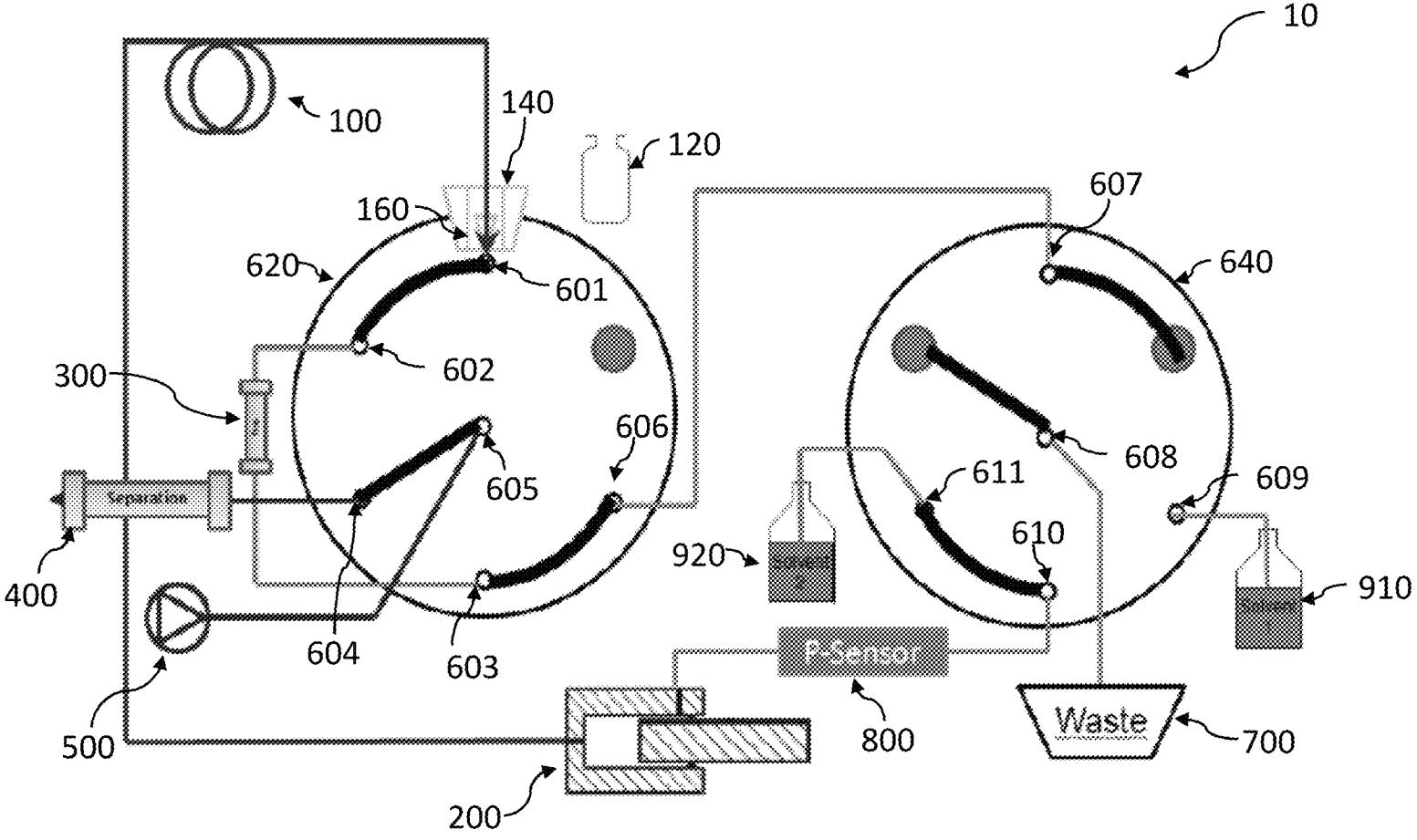
FIG. 6 depicts the exemplary fluidic system 10 in a solvent pick-up mode.

FIG. 6 depicts how the metering device 200 can first fill at least in part with a trap solvent: the right valve 640 connects one port of the metering device 200 to the solvent reservoir 920. The other side is closed via the sample loop 100, the needle seat 160 and the port 607 of the right valve 640. In this position, the piston of the metering device 200 can move back, drawing up solvent 2 (optionally solvent 1). The right valve 640 then switches back to the Compress position as in FIG. 5. The metering device 200 is now closed at the back and front.

Figure 7:
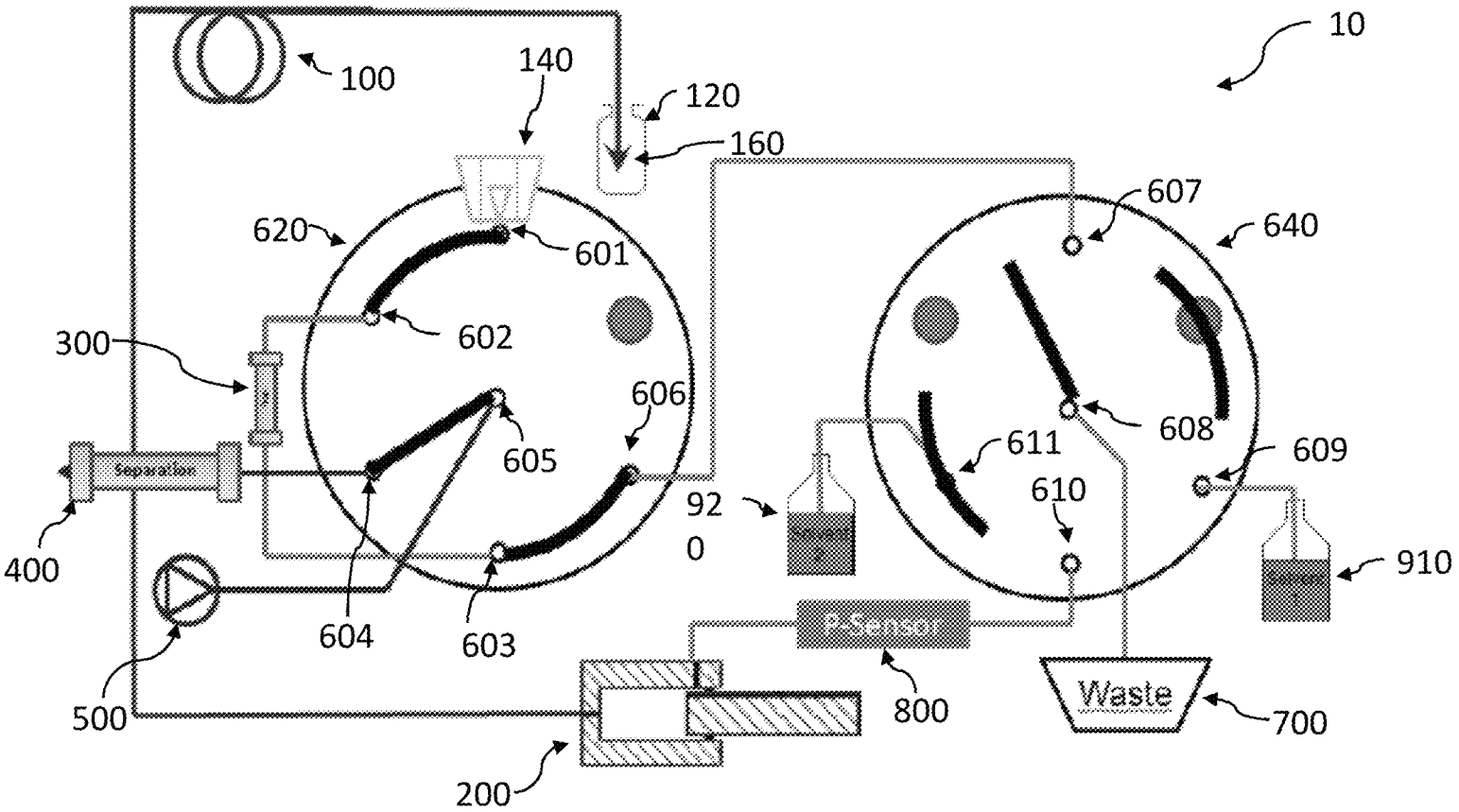
FIG. 7 depicts the exemplary fluidic system 10 in a sample pick-up mode.

FIG. 7 depicts how the metering device 200 may be used further to pick up a sample. The needle 160 moves into the sample reservoir 120 and opens the metering device 200 via the sample loop 100. If the piston now moves back, the sample is drawn up.

FIG. 8 shows the loading process of the fluid in the metering device 200 into the trap column 300. After the sample has been taken up, the needle 160 returns to the needle seat 140. The right valve 640 connects the side of the trap column 300 facing away from the sample to the waste connection 800. In this position, the piston of the metering device 200 can advance, pushing the sample with the previously aspirated trap solvent onto the trap column 300. Components that do not remain attached to the trap column 300 are pushed out to the waste 700. In this step, the above described embodiments of the present invention may be used, as it would take a long time to depressurize after the piston of the metering device 200 is pushed in.

In order to reduce the depressurizing time, the needle 160 may, for example, be moved out of the seat 140, or solvent reservoirs 910 or 920 may be connected to the metering device 200 at any time after the piston is pushed in. The residual pressure may then drop abruptly to ambient pressure (see also FIG. 1). However, since the flow or pressure has been measured by the pressure sensor 800, it is still known how much volume has been trapped so far. Alternatively, the piston may be allowed to move backwards after reaching the front position after any waiting time (that may also be 0 s) until the pressure sensor 800 reports ambient pressure. The net displacement of the piston may then be used to determine the volume loaded into the trap column 300.

The loading process may be repeated if the right valve 640 again connects the rear output of the metering device 200 to solvent reservoirs 910 or 920, thus allowing the metering device 200 to draw up fresh trap solvent. After trapping, the right valve 640 switches back to the compress position (as in FIG. 5).

Figure 9:
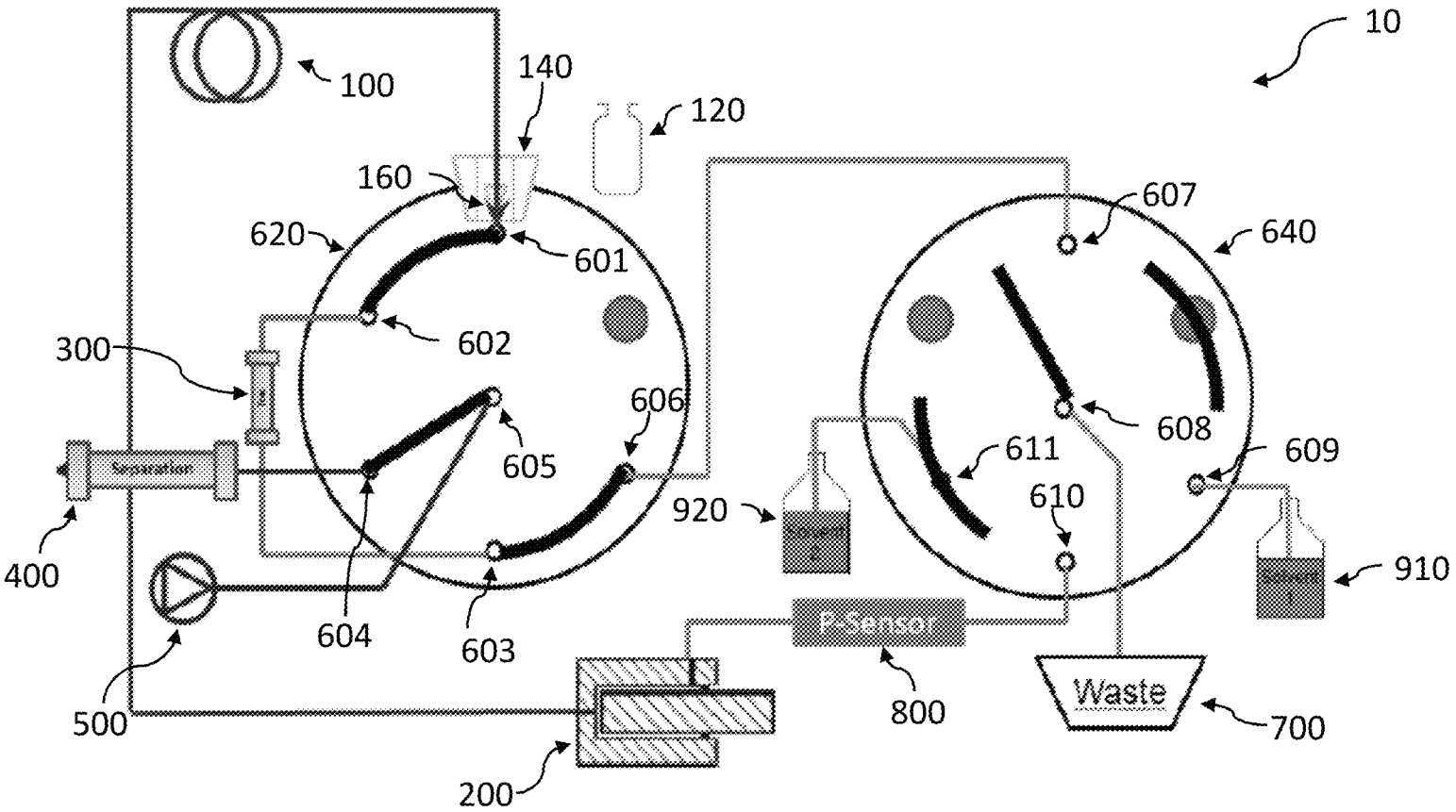
FIG. 9 depicts the exemplary fluidic system 10 in a trap precompression mode.
Figure 10:
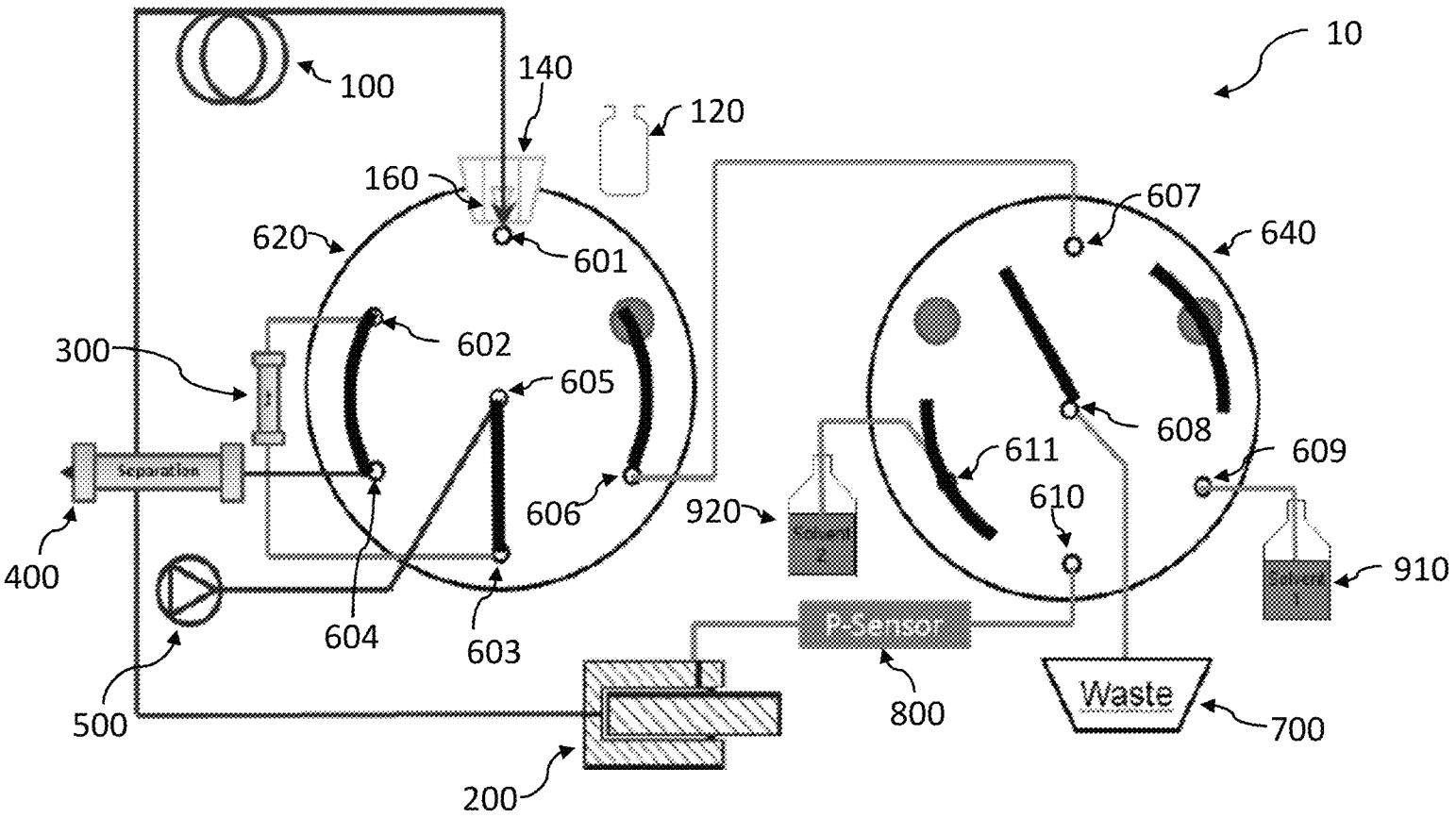
FIG. 10 depicts the exemplary fluidic system 10 in a backward flush mode.
Figure 11:
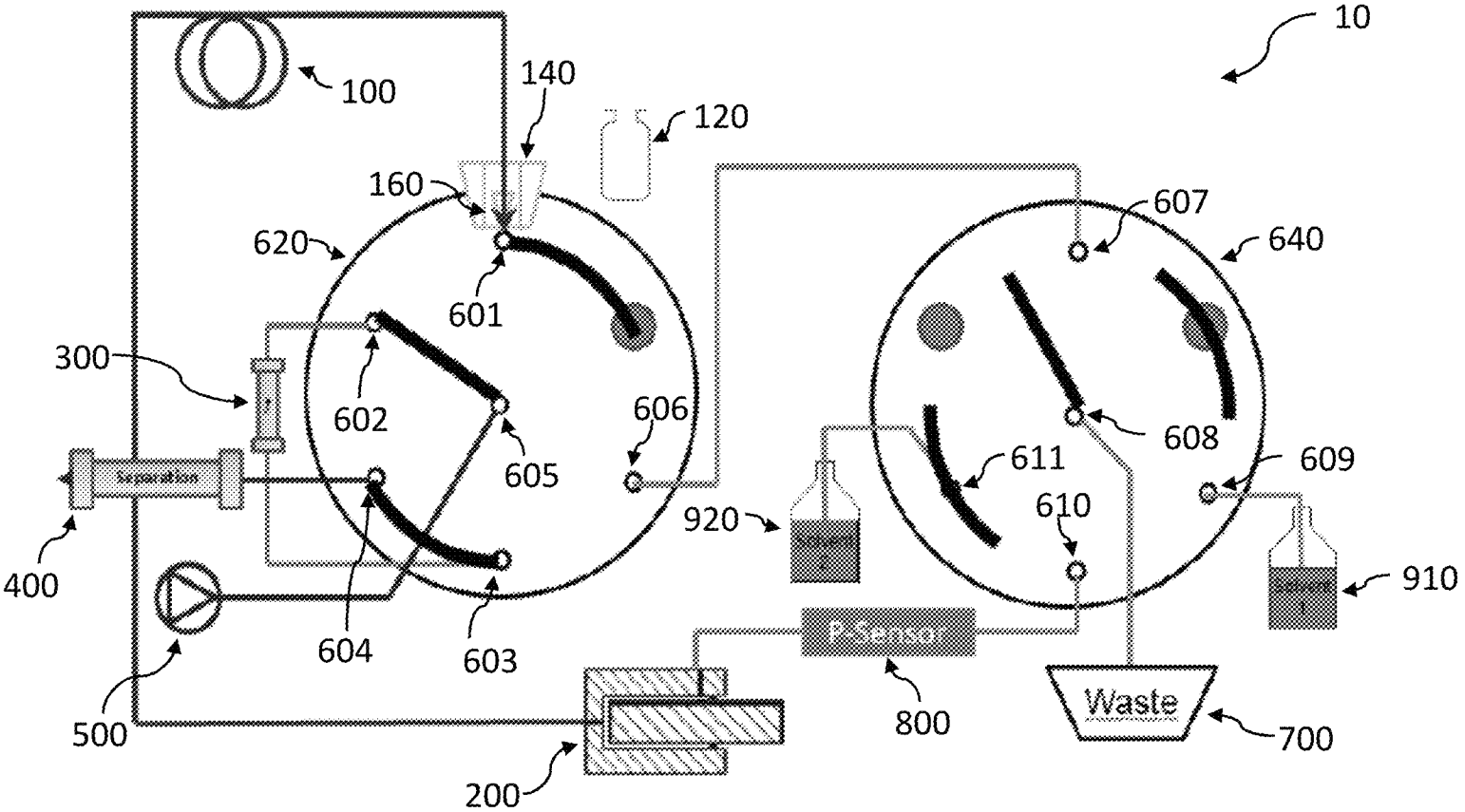
FIG. 11 depicts the exemplary fluidic system 10 in a forward flush mode.

If the piston in the metering device 200 now moves forward as shown in FIG. 9, the volume in the sample loop 100, the trap column 300, the metering device 200 and in the connections is compressed. The volume may be compressed until an analytical pressure (as measured by the pressure sensor 800) is reached. If the first valve 620 (which may for ease of reference also be referred to as the left valve 620) now switches, and the trap column 300 is introduced into the analytical flow. This may be done in such a way that the analytical flow pushes the sample out on the side on which it entered the trap column 100 (backward flush, see FIG. 10) or further in the direction of the trap flow (forward flush, see FIG. 11).

Figure 12:
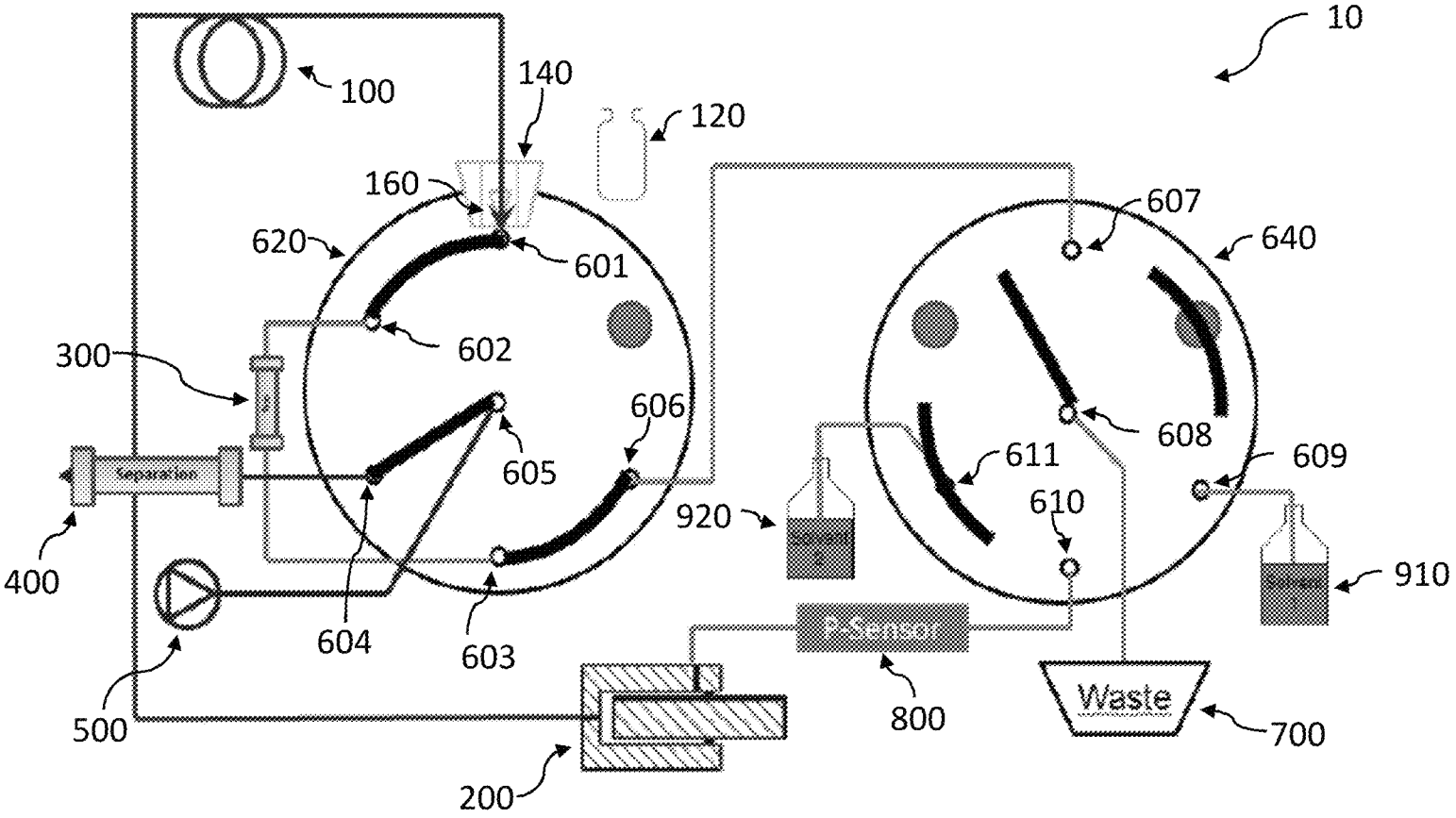
FIG. 12 depicts the exemplary fluidic system 10 in a trap decompression mode.

After completion of the loading, the residual pressure still present in the sample loop 100, metering device 200 and connections may be relieved by switching to the bypass position and moving the piston backwards (see FIG. 12).

Figure 13:
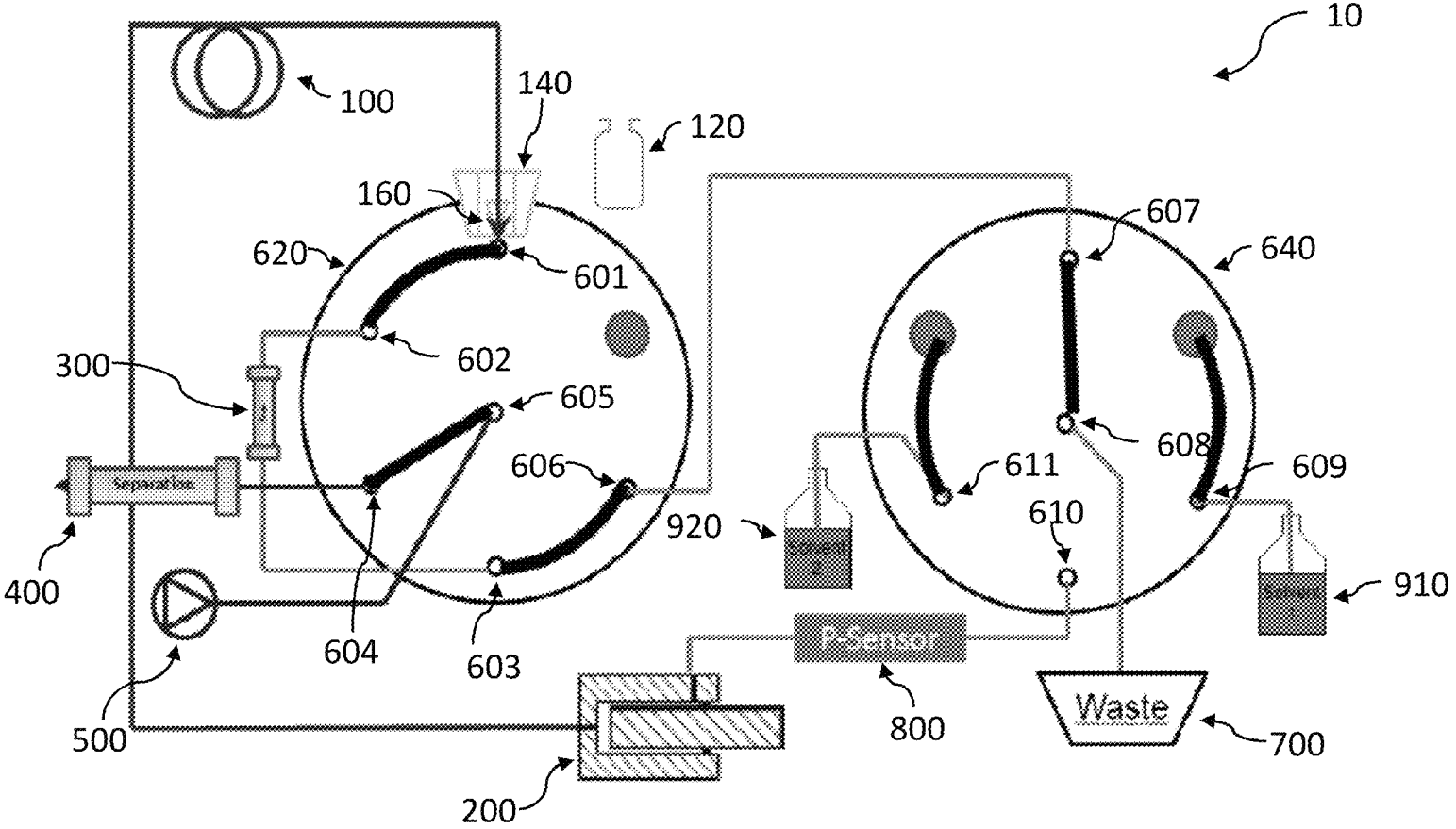
FIG. 13 depicts the exemplary fluidic system 10 in a washing mode.

If any residual pressure remains, it can be released into the waste 700 during the equilibration phase by switching the right valve 640 (see FIG. 13). From this position, the left valve 620 can reconnect the metering device 200 to solvent reservoirs 910 or 920, draw up the respective solvent and use it to wash the loop 100, needle seat 140 and trap column 300.

Thus, the present invention now enables loading with non-continuous pumping equipment by monitoring or controlling the undefined flow at the start of piston movement and after piston travel. These ramps may have been neglected until now. However, they are not negligible in non-continuous loading because they are repetitive. Embodiments of the invention may also be used for positioning a sample plug in a sample loop, and here especially reduces the waiting time until the sample comes to a defined standstill.

The loading process may now also be carried out reproducibly with clearly defined flows using non-continuous pumps. Non-continuous loading may allow the use of smaller and less expensive pumps. Similarly, the invention may enable fast and accurate positioning of sample plugs in a sample loop.

The loading algorithm described above may present several advantages. It may be efficient, since loading may be carried out at the maximum pressure at which the fluidic system 10 may be operated resulting in a high throughput. It may be accurate and precise, owing to the different diagnostic tools disclosed above, resulting in excellent chromatographic performance. Further, it may be smart, with the diagnostic features disclosed above allowing for detection of incorrect parameters or issues of the fluidic system before the separation process is carried out and yields incorrect results.

Whenever a relative term, such as "about", "substantially" or "approximately" is used in this specification, such a term should also be construed to also include the exact term. That is, e.g., "substantially straight" should be construed to also include "(exactly) straight".

Whenever steps were recited in the above or also in the appended claims, it should be noted that the order in which the steps are recited in this text may be accidental. That is, unless otherwise specified or unless clear to the skilled person, the order in which steps are recited may be accidental. That is, when the present document states, e.g., that a method comprises steps (A) and (B), this does not necessarily mean that step (A) precedes step (B), but it is also possible that step (A) is performed (at least partly) simultaneously with step (B) or that step (B) precedes step (A). Furthermore, when a step (X) is said to precede another step (Z), this does not imply that there is no step between steps (X) and (Z). That is, step (X) preceding step (Z) encompasses the situation that step (X) is performed directly before step (Z), but also the situation that (X) is performed before one or more steps (Y1), . . . , followed by step (Z). Corresponding considerations apply when terms like "after" or "before" are used.

While in the above, a preferred embodiment has been described with reference to the accompanying drawings, the skilled person will understand that this embodiment was provided for illustrative purpose only and should by no means be construed to limit the scope of the present invention, which is defined by the claims.

The invention claimed is:

1. A method of loading a fluid into a fluidic element of a fluidic system comprising the fluidic element and a loading pump, wherein the method comprises determining a volume that has flown into the fluidic element since a start time $t_{start}$;

at a switching time $t_{switch}$, switching the fluidic system to an operating state to stop fluid flow into the fluidic element; and operating the loading pump in a loading state from the start time $t_{start}$ to the switching time $t_{switch}$, with the pressure between the loading pump and the fluidic element exceeding atmospheric pressure, and with the loading pump causing fluid to flow into the fluidic element in the loading state.

2. The method according to claim 1, wherein the switching the fluidic system to an operating state to stop fluid flow into the fluidic element comprises switching the loading pump to a stop state, wherein the pressure between the loading pump and the fluidic element equals atmospheric pressure in the stop state.

3. The method according to claim 1, further comprising determining the switch time $t_{switch}$.

4. The method according to claim 1, wherein the determining the switch time $t_{switch}$ is based on the determined volume flown into the fluidic element since the start time $t_{start}$.

5. The method according to claim 1, further comprising sensing a pressure in the loading pump or fluidly connected thereto, and wherein the determining the volume flown into the fluidic element since the start time $t_{start}$ is based on the sensed pressure.

6. The method according to claim 3, wherein the determining the switch time $t_{switch}$ is based on an expected fluid flow ($V_{red}$) into the fluidic element after the switch time $t_{switch}$.

7. The method according to claim 1, wherein the loading pump is a non-continuous pump.

8. The method according to claim 2, further comprising switching a flow out of the fluidic element to zero, varying a pressure of the loading pump and measuring a volume of fluid compressed.

9. The method according to claim 1, further comprising, at the start time $t_{start}$, increasing the pressure in the loading pump to compress the fluid such that no fluid flows out of the fluidic element, and measuring a compression volume $V_{lag}$, and comparing the measured compression volume $V_{lag}$ to an expected compression volume at a corresponding pressure.

10. The method according to claim 1, wherein the maximum pressure between the loading pump and the fluidic element in the loading state exceeds the atmospheric pressure by a maximum differential pressure, wherein 0.2 s to 15 s after the switching time $t_{switch}$, the pressure between the loading pump and the fluidic element minus the atmospheric pressure is less than 10% of the maximum differential pressure.

11. The method according to claim 5, wherein the determining the switch time $t_{switch}$ is based on a compressibility of the fluid at the sensed pressure.

12. The method according to claim 6, wherein the expected fluid flow ($V_{red}$) is obtained by integrating the flow running through the fluidic element during depressurization.

13. The method according to claim 6, wherein the expected fluid flow ($V_{red}$) is based on a fluidic resistance of the fluidic element.

14. The method according to claim 13, further comprising experimentally determining the fluidic resistance for different pressure values.

15. A non-transitory computer-readable storage medium comprising instructions which, when executed on a control unit of a fluidic system, cause the fluidic system to determine a volume flown into the fluidic element since a start time tstart;

at a switching time $t_{switch}$, switch the fluidic system to an operating state to stop fluid flow into the fluidic element; and operate the loading pump in a loading state from the start time tstart to the switching time $t_{switch}$, with the pressure between the loading pump and the fluidic element exceeding atmospheric pressure, and with the loading pump causing fluid to flow into the fluidic element in the loading state.

* * * * *